US009162240B2

(12) United States Patent
Gerson et al.

(10) Patent No.: US 9,162,240 B2
(45) **Date of Patent: *Oct. 20, 2015**

(54) LIQUID CONTAINER SYSTEM FOR A SPRAY GUN

(75) Inventors: Ronald L. Gerson, Carlisle, MA (US); Robert A. Brunell, Forestdale, MA (US); David Anteski, Easton, MA (US)

(73) Assignee: SAINT-GOBAIN ABRASIVES, INC./SAINT-GOBAIN ABRASIE, Worcester, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/367,191

(22) Filed: Feb. 6, 2012

(65) Prior Publication Data

US 2012/0132550 A1 May 31, 2012

Related U.S. Application Data

(63) Continuation of application No. 11/302,970, filed on Dec. 14, 2005, now Pat. No. 8,127,963.

(60) Provisional application No. 60/668,695, filed on Apr. 6, 2005, provisional application No. 60/638,949, filed on Dec. 23, 2004, provisional application No. 60/636,675, filed on Dec. 16, 2004.

(51) Int. Cl.
*B05B 7/24* (2006.01)

(52) U.S. Cl.
CPC ..... *B05B 7/2481* (2013.01); *B05B 7/2408* (2013.01)

(58) Field of Classification Search
CPC ..... B05B 7/2481
USPC ..... 222/386.5, 92; 239/345, 376, 377; 220/784, 495.08, 495.02, 495.11
See application file for complete search history.

(56) References Cited

U.S. PATENT DOCUMENTS 533,489 A 2/1895 Ogram
1,370,687 A 3/1921 Ferris (Continued)

FOREIGN PATENT DOCUMENTS

AU 200032550 B3 7/2000
AU 199935838 A1 1/2001

(Continued)

OTHER PUBLICATIONS

Amended Complaint and Demand for Jury Trial *3M Innovative Properties Company and 3M Company* vs. *Illinois Tool Works, Inc. and ITW Finishing, L.L.C.*, Case No. Jun. 2459 (U.S. District Court, District of Minnesota) filed Aug. 7, 2006 (5 pgs).

(Continued)

*Primary Examiner* — Fenn Mathew
*Assistant Examiner* — Christopher McKinley
(74) *Attorney, Agent, or Firm* — Abel Law Group, LLP; Joseph P. Sullivan

(57) ABSTRACT

A liquid container assembly for a spray gun can include a ring, a collapsible liner, and a lid for closing the open end of the liner. The ring can include a peripheral flange, a ring recess, an inner wall, and at least one rib segment extending from the inner wall. The collapsible liner can include a liner side wall formed with an open end and a liner lip at the open end. The liner can be is insertable through the ring such that the liner lip is received and supported by the ring recess. Further, the liner can be collapsible during use as liquid is removed from the liner. The lid can include at least one tab that can extend from an outer circumference of the lid. The tabs can engage the rib segments to threadably attach to the ring.

20 Claims, 20 Drawing Sheets

(56) References Cited

U.S. PATENT DOCUMENTS 1,556,913 A 10/1924 Capra
1,703,384 A 2/1929 Birkenmaier
1,722,101 A 7/1929 Little
1,748,440 A 2/1930 Burdick
1,843,269 A 2/1932 Capser
1,843,899 A 2/1932 Martinet
2,004,574 A 6/1935 Gee, Jr.
2,051,518 A 8/1936 Cunningham
D105,960 S 9/1937 Lieberman
2,177,032 A 10/1939 Baumgardner
2,200,675 A 5/1940 Northcutt
2,228,861 A 1/1941 Wegener
2,310,633 A 2/1943 Heimburger
2,318,717 A 5/1943 Rose
2,593,639 A 4/1952 Whitehouse
2,593,839 A 4/1952 Buc
2,595,317 A 5/1952 White
2,606,586 A 8/1952 Hill
2,612,404 A 9/1952 Andersson
2,641,365 A 6/1953 Lundeen
2,656,217 A 10/1953 Roche
2,670,239 A 2/1954 Ditch
2,670,882 A 3/1954 Best
2,720,998 A 10/1955 Potter
2,770,706 A 11/1956 Vogtle et al.
2,795,461 A 6/1957 Durkin
2,851,187 A 9/1958 Hall
2,877,934 A 3/1959 Wallace
2,901,182 A 8/1959 Cragg et al.
2,959,358 A 11/1960 Vork
3,000,576 A 9/1961 Levey et al.
3,035,623 A 5/1962 Goetz
3,066,872 A 12/1962 Kobee
3,134,494 A 5/1964 Quinn
3,136,486 A * 6/1964 Docken ..... 239/346
3,157,360 A 11/1964 Heard
3,163,544 A 12/1964 Valyi
3,167,210 A * 1/1965 Carney, Jr. ..... 220/495.05
3,186,643 A 6/1965 George et al.
3,195,819 A 7/1965 Watanabe
3,198,438 A 8/1965 Hultgren
3,211,324 A 10/1965 Sapien
3,227,305 A 1/1966 Enssle
3,236,459 A 2/1966 McRitchie
3,240,398 A 3/1966 Dalton, Jr.
3,255,972 A 6/1966 Hultgren et al.
3,260,464 A 7/1966 Harant
3,335,913 A 8/1967 Bouet
3,362,640 A 1/1968 Fainman
3,381,845 A * 5/1968 MacDonald ..... 220/301
3,393,842 A 7/1968 Bruce et al.
3,401,842 A * 9/1968 Morrison ..... 222/183
3,406,853 A 10/1968 McLeod
3,432,104 A 3/1969 Kaltenbach
3,487,989 A 1/1970 Rausing et al.
3,507,309 A 4/1970 Johnson
3,524,589 A 8/1970 Pelton, Jr.
3,593,921 A 7/1971 Boltic
3,606,092 A 9/1971 Kollmai
3,672,645 A 6/1972 Terrels et al.
3,674,074 A 7/1972 Lavis
3,757,718 A 9/1973 Johnson
3,773,211 A 11/1973 Bridgman
3,776,408 A 12/1973 Wald
3,779,419 A * 12/1973 Heitz ..... 220/495.11
3,780,950 A 12/1973 Brennan
3,784,039 A 1/1974 Marco
3,790,017 A 2/1974 Fitzpatrick et al.
3,790,021 A 2/1974 Bailey
3,841,555 A 10/1974 Lilja
3,853,157 A 12/1974 Madaio
3,858,810 A * 1/1975 Seeley et al. ..... 239/121
3,892,360 A 7/1975 Schlottmann et al.
3,934,746 A 1/1976 Lilja
3,937,367 A 2/1976 Hood
3,939,842 A 2/1976 Harris
3,940,052 A 2/1976 McHugh
4,035,004 A 7/1977 Hengesbach
4,043,510 A * 8/1977 Morris ..... 239/323
4,067,499 A 1/1978 Cohen
4,069,751 A 1/1978 Gronwick et al.
4,088,268 A 5/1978 Vohringer
4,095,720 A 6/1978 Delbrouck et al.
4,122,973 A 10/1978 Ahern
4,140,279 A 2/1979 Hawkins
4,151,929 A 5/1979 Sapien
4,159,081 A 6/1979 Demler et al.
4,186,783 A 2/1980 Brandt
4,193,506 A 3/1980 Trindle et al.
D257,668 S 12/1980 Ahern
4,258,862 A 3/1981 Thorsheim
4,307,820 A * 12/1981 Binoche ..... 220/374
4,321,922 A 3/1982 Deaton
4,339,046 A 7/1982 Coen
4,347,948 A 9/1982 Hamada et al.
4,379,455 A 4/1983 Deaton
4,383,635 A 5/1983 Yotoriyama
4,388,044 A 6/1983 Wilkinson
4,401,274 A 8/1983 Coffee
4,403,738 A 9/1983 Kern
4,405,088 A 9/1983 Gray
4,406,406 A 9/1983 Knapp
4,411,387 A 10/1983 Stern et al.
4,418,843 A 12/1983 Jackman
4,430,084 A * 2/1984 Deaton ..... 604/317
4,442,003 A 4/1984 Holt
4,455,140 A 6/1984 Joslin
4,457,455 A 7/1984 Meshberg
4,491,254 A 1/1985 Viets et al.
4,516,693 A 5/1985 Gaston
4,558,792 A 12/1985 Cabernoch et al.
4,559,140 A 12/1985 Croteau
4,562,965 A 1/1986 Ihmels et al.
D283,832 S 5/1986 Weinstein et al.
4,586,628 A 5/1986 Nittel
4,621,770 A 11/1986 Sayen
4,623,095 A 11/1986 Pronk
4,625,890 A * 12/1986 Galer ..... 220/319
4,628,644 A 12/1986 Somers
4,633,052 A 12/1986 Beavers et al.
4,645,097 A 2/1987 Kaufman
4,653,691 A 3/1987 Grime
4,657,151 A 4/1987 Cabernoch
D290,990 S 7/1987 Izzi
4,693,423 A 9/1987 Roe et al.
4,712,739 A 12/1987 Bihn
4,760,962 A 8/1988 Wheeler
4,781,311 A 11/1988 Dunning et al.
4,811,904 A 3/1989 Ihmels et al.
4,813,556 A 3/1989 Lawrence
4,813,609 A 3/1989 French
D300,555 S 4/1989 Patterson
4,818,589 A 4/1989 Johnson et al.
4,824,018 A 4/1989 Shreve
4,836,764 A 6/1989 Parkinson
4,909,409 A 3/1990 Shreve
4,925,055 A * 5/1990 Robbins et al. ..... 220/495.06
4,930,644 A 6/1990 Robbins, III
4,936,511 A 6/1990 Johnson et al.
D309,858 S 8/1990 Meyersburg
4,946,558 A 8/1990 Salmon
4,951,875 A 8/1990 Devey
4,961,537 A 10/1990 Stern
4,962,885 A 10/1990 Coffee
4,971,251 A 11/1990 Dobrick et al.
4,979,628 A 12/1990 Robbins, III
4,982,868 A 1/1991 Robbins, III
4,998,696 A 3/1991 Desjardins
4,999,109 A 3/1991 Sabre
5,005,726 A 4/1991 Robbins
5,035,339 A 7/1991 Meyersburg
5,052,623 A 10/1991 Nordeen
5,054,687 A 10/1991 Burns et al.
5,059,319 A 10/1991 Welsh

(56) References Cited

U.S. PATENT DOCUMENTS 5,060,816 A 10/1991 Robbins, III
5,069,389 A 12/1991 Bitsakos
5,071,070 A 12/1991 Hardy
5,078,322 A 1/1992 Torntore
5,078,323 A 1/1992 Frank
5,094,543 A * 3/1992 Mursa ..... 366/247
5,102,052 A 4/1992 Demarest et al.
5,102,384 A 4/1992 Ross et al.
5,118,003 A * 6/1992 Pepper et al. ..... 220/495.08
5,119,992 A 6/1992 Grime
5,123,571 A 6/1992 Rebeyrolle et al.
5,143,242 A 9/1992 Millasich
5,143,294 A 9/1992 Lintvedt
5,186,828 A 2/1993 Mankin
5,209,365 A 5/1993 Wood
5,209,501 A 5/1993 Smith
5,236,128 A 8/1993 Morita et al.
5,236,506 A 8/1993 Mazakas
5,238,150 A 8/1993 Williams
5,248,089 A * 9/1993 Bekius ..... 239/154
5,248,096 A 9/1993 Hoey et al.
D341,189 S 11/1993 Legassie et al.
5,259,400 A 11/1993 Bruno et al.
5,261,751 A 11/1993 Heinz
5,267,693 A 12/1993 Dickey
5,269,840 A 12/1993 Morris et al.
5,295,606 A 3/1994 Karwoski
5,308,647 A 5/1994 Lappi
5,326,001 A 7/1994 Holmquist et al.
5,328,095 A 7/1994 Wickenhaver
5,332,158 A 7/1994 Styne et al.
5,337,921 A 8/1994 Wilson et al.
5,341,836 A 8/1994 Doherty
5,358,402 A 10/1994 Reed et al.
5,368,395 A 11/1994 Crimmins
5,377,852 A 1/1995 Demorest
5,381,918 A * 1/1995 Dahl ..... 220/784
5,385,251 A 1/1995 Dunn
5,400,573 A 3/1995 Crystal et al.
5,405,090 A 4/1995 Greene et al.
5,415,352 A 5/1995 May
5,421,489 A 6/1995 Holzner, Sr. et al.
5,424,086 A 6/1995 Walker
5,454,488 A 10/1995 Geier
5,460,289 A 10/1995 Gemmell
5,462,711 A 10/1995 Ricottone
5,468,383 A 11/1995 McKenzie
5,492,242 A 2/1996 Gall
5,501,397 A 3/1996 Holt
5,569,377 A 10/1996 Hashimoto
5,582,350 A 12/1996 Kosmyna et al.
5,607,082 A 3/1997 Cracauer
5,617,972 A 4/1997 Morano et al.
5,631,055 A 5/1997 Vines et al.
5,655,714 A 8/1997 Kieffer et al.
5,667,858 A 9/1997 Pokorny
D386,654 S 11/1997 Kosmyna
5,695,837 A 12/1997 Everaerts et al.
5,713,519 A 2/1998 Sandison et al.
5,789,684 A 8/1998 Masek et al.
5,797,520 A 8/1998 Donahue
5,803,302 A 9/1998 Sato et al.
5,803,360 A 9/1998 Spitznagel
5,803,367 A 9/1998 Heard et al.
5,806,711 A * 9/1998 Morano et al. ..... 221/33
5,816,431 A 10/1998 Giannopoulos
5,816,501 A * 10/1998 LoPresti et al. ..... 239/302
5,826,795 A 10/1998 Holland et al.
5,829,588 A 11/1998 Bloomfield
5,853,102 A 12/1998 Jarrett
5,863,431 A 1/1999 Salzburg
5,878,899 A 3/1999 Manganiello et al.
5,921,426 A 7/1999 Randolph
5,938,016 A * 8/1999 Erdtmann ..... 206/221
5,954,273 A 9/1999 Ruta et al.
5,964,365 A 10/1999 Peeples et al.
5,967,379 A 10/1999 Crossdale et al.
5,996,427 A 12/1999 Masek et al.
6,019,294 A 2/2000 Anderson et al.
6,027,041 A 2/2000 Evans
6,053,429 A 4/2000 Chang
6,092,740 A * 7/2000 Liu ..... 239/346
D431,279 S 9/2000 Spriegel
6,196,410 B1 3/2001 Hocking
6,257,429 B1 7/2001 Kong
6,264,115 B1 7/2001 Liska et al.
6,287,669 B1 9/2001 George et al.
D449,381 S 10/2001 de Begon de Larouziere
6,302,445 B1 10/2001 Kugele et al.
6,371,385 B1 4/2002 Schiller et al.
6,390,386 B2 5/2002 Krohn et al.
D460,825 S 7/2002 Renz
6,435,426 B1 8/2002 Copp, Jr.
D462,268 S 9/2002 Schroeder et al.
6,455,140 B1 9/2002 Whitney et al.
6,475,609 B1 11/2002 Whitney et al.
6,536,684 B1 3/2003 Wei
6,536,687 B1 3/2003 Navis et al.
6,588,681 B2 * 7/2003 Rothrum et al. ..... 239/328
6,595,441 B2 * 7/2003 Petrie et al. ..... 239/345
6,663,018 B2 12/2003 Rothrum et al.
6,698,670 B1 * 3/2004 Gosis et al. ..... 239/376
6,712,292 B1 3/2004 Gosis et al.
6,717,673 B1 4/2004 Janssen et al.
6,752,179 B1 6/2004 Schwartz
6,796,514 B1 9/2004 Schwartz
6,820,824 B1 * 11/2004 Joseph et al. ..... 239/346
6,871,594 B1 3/2005 Estrella
6,877,677 B2 4/2005 Schmon et al.
6,899,239 B1 5/2005 Gray
6,938,836 B2 9/2005 Bouic
6,942,126 B2 9/2005 Douglas et al.
6,945,429 B2 9/2005 Gosis et al.
6,946,122 B2 9/2005 Yang
6,953,155 B2 10/2005 Joseph et al.
6,958,033 B1 10/2005 Malin
6,982,108 B2 1/2006 Janssen et al.
7,083,119 B2 8/2006 Bouic et al.
7,086,549 B2 8/2006 Kosmyna et al.
7,128,102 B2 10/2006 Pendleton et al.
7,143,960 B2 12/2006 Joseph et al.
7,159,734 B1 * 1/2007 O'Brien ..... 220/495.07
7,165,732 B2 1/2007 Kosmyna et al.
7,172,139 B2 * 2/2007 Bouic et al. ..... 239/345
7,188,785 B2 3/2007 Joseph et al.
7,296,759 B2 11/2007 Alexander et al.
7,344,040 B2 3/2008 Kosmyna et al.
7,353,964 B2 4/2008 Kosmyna
7,354,074 B2 4/2008 Kosmyna et al.
7,374,111 B2 5/2008 Joseph et al.
7,380,680 B2 * 6/2008 Kosmyna et al. ..... 220/23.87
7,451,884 B2 11/2008 Kuehn et al.
D582,512 S 12/2008 Fontaine
D586,059 S 2/2009 Bechtold, Jr.
7,568,638 B2 8/2009 Gehrung
7,625,016 B2 12/2009 Kosmyna et al.
D615,161 S 5/2010 Gerson et al.
7,757,972 B2 7/2010 Kosmyna et al.
7,798,421 B2 9/2010 Joseph et al.
7,798,425 B2 9/2010 Joseph et al.
7,798,426 B2 9/2010 Joseph et al.
7,798,427 B2 9/2010 Joseph et al.
7,802,763 B2 9/2010 Faller et al.
7,810,744 B2 10/2010 Schmon et al.
7,819,263 B1 10/2010 DiCarlo-Nelson
7,819,341 B2 10/2010 Schmon et al.
7,823,806 B2 11/2010 Schmon
7,878,425 B2 2/2011 Handzel et al.
8,002,200 B2 8/2011 Joseph et al.
8,033,413 B2 10/2011 Gerson et al.
8,052,071 B2 11/2011 Kruse
8,127,963 B2 3/2012 Gerson et al.
8,201,709 B1 6/2012 Namigata et al.
8,272,255 B2 9/2012 Halverson et al.

(56) References Cited

U.S. PATENT DOCUMENTS

| | | | | |
|---|---|---|---|---|
| 8,444,067 | B2 | 5/2013 | Schmon et al. | |
| 2002/0014541 | A1 | 2/2002 | Krohn et al. | |
| 2002/0121139 | A1 | 9/2002 | Purpura et al. | |
| 2003/0003301 | A1 | 1/2003 | Whitney et al. | |
| 2003/0008144 | A1 | 1/2003 | Whitney et al. | |
| 2003/0209573 | A1 | 11/2003 | Bouic | |
| 2004/0016825 | A1 | 1/2004 | Petrie et al. | |
| 2004/0067350 | A1 | 4/2004 | Janssen et al. | |
| 2004/0084553 | A1 | 5/2004 | Joseph et al. | |
| 2004/0118941 | A1 | 6/2004 | Joseph et al. | |
| 2004/0140373 | A1* | 7/2004 | Joseph et al. | 239/379 |
| 2004/0164182 | A1 | 8/2004 | Joseph et al. | |
| 2004/0217201 | A1* | 11/2004 | Ruda | 239/376 |
| 2004/0232714 | A1 | 11/2004 | Coppotelli et al. | |
| 2004/0256484 | A1 | 12/2004 | Joseph et al. | |
| 2004/0256485 | A1* | 12/2004 | Joseph et al. | 239/302 |
| 2005/0029285 | A1* | 2/2005 | Gay et al. | 222/1 |
| 2005/0045146 | A1 | 3/2005 | McKay et al. | |
| 2005/0067502 | A1* | 3/2005 | Bouic et al. | 239/345 |
| 2005/0092770 | A1 | 5/2005 | Yechouron | |
| 2005/0145718 | A1 | 7/2005 | Blette et al. | |
| 2005/0145723 | A1 | 7/2005 | Blette et al. | |
| 2005/0145724 | A1 | 7/2005 | Blette et al. | |
| 2005/0156058 | A1 | 7/2005 | Kosmyna et al. | |
| 2005/0241722 | A1 | 11/2005 | Pendleton et al. | |
| 2005/0242107 | A1 | 11/2005 | Kosmyna et al. | |
| 2005/0258271 | A1 | 11/2005 | Kosmyna et al. | |
| 2005/0263614 | A1* | 12/2005 | Kosmyna et al. | 239/345 |
| 2005/0279748 | A1* | 12/2005 | Kosmyna | 220/495.02 |
| 2006/0000927 | A1 | 1/2006 | Ruda | |
| 2006/0017286 | A1* | 1/2006 | Kosmyna et al. | 285/305 |
| 2006/0043217 | A1 | 3/2006 | Kosmyna et al. | |
| 2006/0065591 | A1 | 3/2006 | Joseph | |
| 2006/0102550 | A1 | 5/2006 | Joseph et al. | |
| 2006/0144960 | A1 | 7/2006 | Kosmyna et al. | |
| 2006/0151630 | A1* | 7/2006 | Joseph et al. | 239/346 |
| 2006/0157594 | A1 | 7/2006 | Cooke | |
| 2006/0175433 | A1 | 8/2006 | Escoto, Jr. et al. | |
| 2006/0196891 | A1 | 9/2006 | Gerson et al. | |
| 2006/0273204 | A1 | 12/2006 | Joseph et al. | |
| 2006/0283861 | A1 | 12/2006 | Kosmyna et al. | |
| 2007/0131793 | A1 | 6/2007 | Joseph et al. | |
| 2007/0158348 | A1 | 7/2007 | Kosmyna et al. | |
| 2007/0272323 | A1 | 11/2007 | Verhaeghe | |
| 2008/0011879 | A1 | 1/2008 | Gerson et al. | |
| 2008/0054087 | A1* | 3/2008 | Joseph et al. | 239/11 |
| 2008/0118656 | A1 | 5/2008 | Douglas et al. | |
| 2009/0072050 | A1* | 3/2009 | Ruda | 239/345 |
| 2009/0110861 | A1 | 4/2009 | Sherman | |
| 2009/0145980 | A1 | 6/2009 | Jones | |
| 2009/0166443 | A1 | 7/2009 | Joseph et al. | |
| 2009/0183565 | A1 | 7/2009 | Shamoon et al. | |
| 2009/0193880 | A1 | 8/2009 | Halverson et al. | |
| 2009/0200309 | A1 | 8/2009 | Kosmyna et al. | |
| 2010/0108783 | A1 | 5/2010 | Joseph et al. | |
| 2010/0139858 | A1 | 6/2010 | Douglas et al. | |
| 2010/0163645 | A1 | 7/2010 | Johnson et al. | |
| 2010/0243758 | A1 | 9/2010 | Juo | |
| 2010/0288772 | A1 | 11/2010 | Wambeke et al. | |
| 2011/0220737 | A1 | 9/2011 | Kwon | |
| 2011/0266368 | A1 | 11/2011 | Joseph et al. | |
| 2012/0256010 | A1 | 10/2012 | Joseph et al. | |
| 2012/0273583 | A1 | 11/2012 | Gerson et al. | |
| 2012/0279609 | A1 | 11/2012 | Pellegrino et al. | |
| 2012/0279613 | A1 | 11/2012 | Pellegrino et al. | |
| 2012/0279887 | A1 | 11/2012 | Pellegrino et al. | |
| 2012/0279970 | A1 | 11/2012 | Pellegrino et al. | |
| 2012/0280062 | A1 | 11/2012 | Pellegrino et al. | |
| 2012/0280063 | A1 | 11/2012 | Pellegrino et al. | |
| 2013/0001322 | A1 | 1/2013 | Pellegrino et al. | |

FOREIGN PATENT DOCUMENTS

| | | | |
|---|---|---|---|
| AU | 2004/202537 | A1 | 1/2005 |
| CA | 963436 | | 2/1975 |
| CA | 965388 | | 4/1975 |
| CA | 1006450 | | 3/1977 |
| CA | 1192852 | A | 9/1985 |
| CA | 2099763 | A1 | 7/1992 |
| CA | 2569369 | A1 | 7/1998 |
| CA | 2660187 | A1 | 7/1998 |
| CA | 2595507 | A1 | 6/2006 |
| CA | 2277096 | C | 4/2007 |
| CH | 540159 | A | 8/1973 |
| CH | 688082 | A | 5/1997 |
| CN | 1142830 | C | 3/2004 |
| DE | 534273 | C | 9/1931 |
| DE | 2412743 | A1 | 9/1975 |
| DE | 2900998 | A1 | 7/1980 |
| DE | 3020831 | A1 | 12/1981 |
| DE | 8304005 | U1 | 6/1983 |
| DE | 3439442 | A1 | 4/1986 |
| DE | 3517122 | C1 | 5/1986 |
| DE | 3507734 | A1 | 9/1986 |
| DE | 3346165 | C2 | 4/1987 |
| DE | 8807118 | | 8/1988 |
| DE | G 8807118 | U1 | 9/1988 |
| DE | 4002190 | A1 | 8/1991 |
| DE | 4102326 | A1 | 7/1992 |
| DE | 4209258 | A1 | 9/1993 |
| DE | 19618514 | A1 | 11/1997 |
| DE | 29905100 | U1 | 6/1999 |
| DE | 20117496 | U1 | 1/2002 |
| DE | 29825015 | U1 | 3/2004 |
| DE | 29825119 | U1 | 1/2005 |
| DE | 29825120 | U1 | 2/2005 |
| DE | 98901823 | T1 | 3/2005 |
| DE | 202004003116 | U | 7/2005 |
| DE | 202004003376 | U | 7/2005 |
| DE | 202004006907 | U1 | 10/2005 |
| DE | 69831653 | T2 | 9/2006 |
| DE | 69836570 | T2 | 9/2007 |
| EP | 0092359 | A2 | 10/1983 |
| EP | 0202124 | A2 | 11/1986 |
| EP | 0230364 | A2 | 7/1987 |
| EP | 0345607 | A1 | 12/1989 |
| EP | 0388199 | A2 | 9/1990 |
| EP | 0388696 | A1 | 9/1990 |
| EP | 0467334 | A2 | 1/1992 |
| EP | 0345607 | B1 | 9/1992 |
| EP | 0230364 | B2 | 9/1994 |
| EP | 0624353 | A2 | 11/1994 |
| EP | 0634224 | A1 | 1/1995 |
| EP | 0636548 | A1 | 2/1995 |
| EP | 0678334 | A2 | 10/1995 |
| EP | 0689825 | A1 | 1/1996 |
| EP | 0636548 | B1 | 2/1997 |
| EP | 0536344 | B1 | 10/1997 |
| EP | 0847809 | A1 | 6/1998 |
| EP | 0740692 | B1 | 12/1998 |
| EP | 0624353 | B1 | 2/1999 |
| EP | 0987060 | A1 | 3/2000 |
| EP | 1123957 | A1 | 8/2001 |
| EP | 1047732 | B1 | 9/2002 |
| EP | 1366823 | A1 | 3/2003 |
| EP | 1139841 | B1 | 5/2003 |
| EP | 1047731 | B1 | 6/2003 |
| EP | 1210181 | B1 | 10/2003 |
| EP | 1415719 | A1 | 5/2004 |
| EP | 1424135 | A1 | 6/2004 |
| EP | 1435265 | A2 | 7/2004 |
| EP | 1368129 | B1 | 6/2005 |
| EP | 1566223 | A2 | 8/2005 |
| EP | 1579922 | A1 | 9/2005 |
| EP | 1611960 | A1 | 1/2006 |
| EP | 1415719 | B1 | 11/2006 |
| EP | 000638176-0001 | | 1/2007 |
| EP | 1961488 | A2 | 8/2008 |
| EP | 2090372 | A2 | 8/2009 |
| EP | 2090373 | A2 | 8/2009 |

(56) References Cited

FOREIGN PATENT DOCUMENTS

| | | | |
|---|---|---|---|
| EP | 2105208 | A2 | 9/2009 |
| EP | 1435265 | B1 | 11/2009 |
| EP | 2221112 | A2 | 8/2010 |
| EP | 1385632 | B1 | 3/2011 |
| EP | 2090372 | A3 | 11/2011 |
| EP | 2090373 | A3 | 11/2011 |
| EP | 2105208 | A3 | 11/2011 |
| FR | 1282085 | | 12/1960 |
| FR | 1282085 | | 1/1962 |
| FR | 2631254 | A1 | 11/1989 |
| FR | 2639324 | A1 | 5/1990 |
| FR | 2798868 | A1 | 3/2001 |
| GB | 202363 | A | 8/1923 |
| GB | 256179 | A | 6/1927 |
| GB | 290866 | A | 5/1928 |
| GB | 843161 | A | 8/1960 |
| GB | 1077369 | A | 7/1967 |
| GB | 1567685 | | 5/1980 |
| GB | 2103173 | A | 2/1983 |
| GB | 2170471 | A | 8/1986 |
| GB | 2239821 | A | 7/1991 |
| GB | 2303087 | A | 2/1997 |
| JP | 52113870 | | 9/1977 |
| JP | 64-27659 | | 1/1989 |
| JP | JUM3-81879 | U | 8/1991 |
| JP | JUM 05-39671 | U | 5/1993 |
| JP | 6-328014 | A | 11/1994 |
| JP | 6-335643 | A | 12/1994 |
| JP | 7-289956 | A | 11/1995 |
| JP | A 08-133338 | | 5/1996 |
| JP | JUM 3027372 | | 5/1996 |
| JP | 8-192851 | A | 7/1996 |
| JP | 10007170 | A | 1/1998 |
| JP | 11-028394 | A | 2/1999 |
| JP | 2001508698 | A | 7/2001 |
| JP | 2001-252599 | A | 9/2001 |
| JP | 2007-130521 | | 5/2007 |
| JP | 2008-036561 | A | 2/2008 |
| JP | 2008036561 | A | 2/2008 |
| KR | 10-2007-0023711 | A | 2/2007 |
| KR | 10-2010-0052366 | A | 5/2010 |
| WO | 90-015758 | | 12/1990 |
| WO | 90-15758 | A1 | 12/1990 |
| WO | 9206794 | A1 | 4/1992 |
| WO | 92/11930 | A1 | 7/1992 |
| WO | 92/14437 | A1 | 9/1992 |
| WO | 92/19386 | A1 | 11/1992 |
| WO | 9403337 | A2 | 2/1994 |
| WO | 9408730 | A1 | 4/1994 |
| WO | 95/07762 | A1 | 3/1995 |
| WO | 95/11170 | A1 | 4/1995 |
| WO | 9519402 | A1 | 7/1995 |
| WO | 98/00796 | A2 | 1/1998 |
| WO | 98/32539 | A1 | 7/1998 |
| WO | 99/06301 | A1 | 2/1999 |
| WO | 9936477 | A1 | 7/1999 |
| WO | 9936478 | A1 | 7/1999 |
| WO | 9940580 | A1 | 8/1999 |
| WO | 99/50153 | A1 | 10/1999 |
| WO | 00/30844 | A1 | 6/2000 |
| WO | 00/38562 | A1 | 7/2000 |
| WO | 0114766 | A1 | 3/2001 |
| WO | 02072276 | A1 | 9/2002 |
| WO | 02/085533 | A1 | 10/2002 |
| WO | 03/006170 | A2 | 1/2003 |
| WO | 03/045575 | A1 | 6/2003 |
| WO | 03095101 | A1 | 11/2003 |
| WO | 2004030938 | A1 | 4/2004 |
| WO | 2004030939 | A1 | 4/2004 |
| WO | 2004/037432 | A1 | 5/2004 |
| WO | 2004/037433 | A1 | 5/2004 |
| WO | 2004/060574 | A1 | 7/2004 |
| WO | 2004/060575 | A1 | 7/2004 |
| WO | 2004/082848 | A1 | 9/2004 |
| WO | 2004/094072 | A1 | 11/2004 |
| WO | 2005/077543 | A1 | 8/2005 |
| WO | 2005/115631 | A1 | 12/2005 |
| WO | 2005/118151 | A1 | 12/2005 |
| WO | 2005/120178 | A2 | 12/2005 |
| WO | 2005/120718 | A1 | 12/2005 |
| WO | 2006/002497 | A1 | 1/2006 |
| WO | 2006/065850 | A1 | 6/2006 |
| WO | 2006069015 | A1 | 6/2006 |
| WO | 2006098799 | A3 | 9/2006 |
| WO | 2007/037921 | A1 | 4/2007 |
| WO | 2007075724 | A2 | 7/2007 |
| WO | 2006098799 | A9 | 9/2007 |
| WO | 2007/149760 | A2 | 12/2007 |
| WO | 2007/149760 | A3 | 12/2007 |
| WO | 2008022027 | A2 | 2/2008 |
| WO | 2008060939 | A1 | 5/2008 |
| WO | 2008109733 | A1 | 9/2008 |
| WO | 2008154559 | A1 | 12/2008 |
| WO | 2009058466 | A1 | 5/2009 |
| WO | 2009/076150 | A2 | 6/2009 |
| WO | 2009/076150 | A3 | 6/2009 |
| WO | 2009120547 | A2 | 10/2009 |
| WO | 2012/068316 | A2 | 5/2012 |
| WO | 2012/154619 | A2 | 11/2012 |
| WO | 2012/154621 | A2 | 11/2012 |
| WO | 2012/154622 | A2 | 11/2012 |
| WO | 2012/154623 | A2 | 11/2012 |
| WO | 2012/154624 | A2 | 11/2012 |
| WO | 2012/154625 | A2 | 11/2012 |
| WO | 2013/003592 | A2 | 1/2013 |

OTHER PUBLICATIONS

Answer and Counter-Claim to amended Complaint, *3M Innovative Properties Company and 3M Company* vs. *Illinois Tool Works, Inc. and ITW Finishing, L.L.C.*, Case No. 06-2459 (U.S. District Court, District of Minnesota) filed Aug. 21, 2006 (8 pgs).

Answer of Defendants Demand for Jury Trial, *3M Innovative Properties Company and 3M Company* vs. *Louis M. Gerson Co., Inc., and Gerson Professional Products, Inc.*, Civil No. 08-04960 JRT-FLN (U.S. District Court, District of Minnesota), filed Oct. 15, 2008 (4 pages).

Complaint and Demand for Jury Trial, *3M Innovative Properties Company and 3M Company* vs. *Illinois Tool Works, Inc. and ITW DeVilbiss*, Case No. 06-2459 (U.S. District Court, District of Minnesota), filed Jun. 16, 2006 (29 pgs).

Complaint and Demand for Jury Trial, *3M Innovative Properties Company and 3M Company* vs. *Louis M. Gerson Co, Inc., and Gerson Professional Products, Inc.*, Civil No. 08-04960 JRT-FLN (U.S. District Court, District of Minnesota), filed Aug. 19, 2008 (30 pages).

Defendants' Claim Chart, *3M Innovative Properties Company and 3M Company* vs. *Louis M. Gerson Co., Inc., and Gerson Professional Products, Inc.*, Civil No. 08-04960 JRT-FLN (U.S. District Court, District of Minnesota), filed Mar. 2, 2009 (140 pages).

Defendants' Identification of Claim Terms, Phrases or Clauses That May Require Court Construction, *3M Innovative Properties Company and 3M Company* vs. *Louis M. Gerson Co., Inc., and Gerson Professional Products, Inc.*, Civil No. 08-04960 JRT-FLN (U.S. District Court, District of Minnesota), filed Apr. 6, 2009 (3 pages).

Defendant's Prior Art Statement, *3M Innovative Properties Company and 3M Company* vs. *Illinois Tool Works, Inc. and ITW Finishing LLC*, Case No. 06-2459 [U.S. District Court, District of Minnesota] filed Apr. 2, 2007 [12 pages].

Defendants' Prior Art Statement, *3M Innovative Properties Company and 3M Company* vs. *Louis M. Gerson Co., Inc., and Gerson Professional Products, Inc.*, Civil No. 08-04960 JRT-FLN (U.S. District Court, District of Minnesota), filed Mar. 2, 2009 (46 pages).

DeVilbiss PT-500, 510 and 520 2 ½ Gallon Pressure Tank service bulletin—SB-21-041-B., 6 pages.

DeVilbiss Products PT-500, 510 and 520 2 ½ Gallon Pressure Tank, Oct. 1998, 7 pages.

DeVilbiss Industrial Distributor Net Price List Spray Equipment, DDP-104, Supplement 1, Oct. 1, 1988, 3 pages.

(56) References Cited

OTHER PUBLICATIONS

Falkman, M.A. Plastic Discs Scrap Waste for Disposable Containers. Packaging Digest, Jun. 1996, 2 pages.
Louis M. Gerson Co., Inc. and Gerson Professional Products, Inc. Answers to 3M's First Set of Interrogatories to Gerson (Nos. 1-22), *3M Innovative Properties Company and 3M Company* vs. *Louis M. Gerson Co., Inc., and Gerson Professional Products, Inc*., Civil No. 08-04960 JRT-FLN (U.S. District Court, District of Minnesota), filed Dec. 11, 2008 (14 pages).
Notice of Opposition and Grounds of Opposition to European Patent No. EP 0954381, *Illinois Tool Works, Inc*. vs. *3M Company*, dated Jun. 19, 2006, 21 pages.
Plaintiffs' Claim Chart, *3M Innovative Properties Company and 3M Company* vs. *Louis M. Gerson Co., Inc., and Gerson Professional Products, Inc*., Civil No. 08-04960 JRT-FLN (U.S. District Court, District of Minnesota), filed Feb. 2, 2009 (52 pages).
Plaintiffs' Prior Art Statement, *3M Innovative Properties Company and 3M Company* vs. *Louis M. Gerson Co., Inc., and Gerson Professional Products, Inc*., Civil No. 08-04960 JRT-FLN (U.S. District Court, District of Minnesota), filed Apr. 1, 2009 (25 pages).
SATA Jet 90, Operating Instructions, SATA-Fabspritztechnik GmH & Co., 6 pages.
SATA GmbH & Co. KG, "SATA RPS—The cup system for mixing and painting", K-126995/4022-063, 4 pages.
Service Bulletin, SB-4-043-D, Replaces SB-4-043-C, De Vilbiss, "120175 (GFC-502) 32 OZ. Aluminum Gravity Feed Cup with Disposable Lid and Cup Liner", May 2000.
Service Bulletin; SB-21-041-B, replaces SB-21-041-A, PT-500, 510, and 520 2 ½ Gallon Pressure Tank, Oct. 1987 product literature, 6 pages.
International Search Report for PCT Application No. PCT/US05/45146 dated Apr. 21, 2006.
International Search Report for PCT Application No. PCT/US11/61091 dated May 11, 2012.
International Search Report for PCT Application No. PCT/US12/36680 dated Nov. 16, 2012.
International Search Report for PCT Application No. PCT/US12/36684 dated Nov. 23, 2012.
International Search Report for PCT Application No. PCT/US12/36682 dated Nov. 23, 2012.
International Search Report for PCT Application No. PCT/US12/36685 dated Nov. 23, 2012.
International Search Report for PCT Application No. PCT/US12/36686 dated Nov. 23, 2012.
International Search Report for PCT Application No. PCT/US12/36687 dated Nov. 30, 2012.
Inter Partes Reexamination of U.S. Pat. No. 7,374,111 filed Dec. 9, 2008, issued Reexamination No. 95/000,422, 86 pages.
International Search Report for PCT Application No. PCT/US12/44648 dated Jan. 24, 2013.
U.S. Appl. No. 13/728,678, filed Dec. 27, 2012, entitled "Convertible Paint Cup Assembly with Air Inlet Valve".
International Search Report for PCT Application No. PCT/US2012/071843 dated Apr. 29, 2013.

* cited by examiner

LIQUID CONTAINER SYSTEM FOR A SPRAY GUN

CROSS-REFERENCE TO RELATED APPLICATION(S)

This application is a continuation of U.S. non-provisional patent application Ser. No. 11/302,970, filed Dec. 14, 2005, entitled "Liquid Container System for a Spray Gun", the disclosure of which application is incorporated herein by reference. This application claims priority from U.S. provisional patent application Ser. No. 60/668,695, filed Apr. 6, 2005, entitled "Liquid Container System for a Spray Gun", the disclosure of which application is incorporated herein by reference; this application also claims priority from U.S. provisional patent application Ser. No. 60/638,949, filed Dec. 23, 2004, entitled "Liquid Container with Lid and Disposable Liner," which application is incorporated herein by reference; and this application also claims priority from U.S. provisional patent application Ser. No. 60/636,675, filed Dec. 16, 2004, entitled "Liquid Container with Lid and Disposable Liner," which application is incorporated herein by reference.

BACKGROUND

Spray guns are widely used for rapidly coating surfaces with liquids, such as paint. Liquid is contained in a container that attaches to the gun. The outlet of the container is typically a threaded coupling that connects to a corresponding threaded connector on the spray gun. Liquid flows from the container into the spray gun and is fed to a spray nozzle. The spray nozzle combines the liquid with compressed air, atomizing the liquid, forming a spray. At the end of the spraying operation, the container and the mating connection to the spray gun must be thoroughly cleaned so that liquid from one operation does not contaminate the liquid to be sprayed in the next spraying operation. Additionally, the coupling between container and spray gun must not retain any dried liquid that might interfere with the connection between container and spray gun. A container with a disposable liner and lid may be used advantageously to eliminate or reduce the labor required to clean the container and the coupling to the spray gun. A spray gun system with a disposable liner is described in U.S. Pat. No. 6,820,824 to Joseph et al. Other spray gun systems with liners are described in U.S. Pat. No. 3,432,104 to Kaltenbach; U.S. Pat. No. 4,151,929 to Sapien; and U.S. Pat. No. 5,816,501 to Lopresti.

SUMMARY OF THE INVENTION

In a first embodiment of the invention, a three piece liquid container system is provided. The system includes an outer cup, a disposable, collapsible liner for insertion into the outer cup and a removable lid that fits tightly into an opening in the liner. The liner is inserted into the cup and liquid is poured into the liner. The lid includes tabs on its periphery that mate with rib segments on the inside of an opening of the outer cup. The lid is inserted into the liner and then rotated to secure the lid/liner to the cup. The lid can include locking tabs that prevent the lid from rotating in reverse.

In other embodiments of the invention, the cup may include features, such as faceted sidewalls and protrusions on its inside bottom surface, that prevent close contact between the collapsible liner and the cup. These features facilitate complete expulsion of liquid from the liner during spraying. In certain other embodiments of the invention, an adapter is provided to connect the reservoir to the spray gun inlet port without requiring rotation of the reservoir relative to the adapter or the spray gun. The adapter may be secured to an outlet port of the lid by a removable collar, preferably threaded for screwing engagement.

In further embodiments of the present invention, a four piece liquid container system is provided for attachment to a spray gun. The system includes an outer cup, a mounting ring, a liner and a removable lid. The mounting ring is inserted into a recess in a flange at the top of the outer cup. A disposable, collapsible liner is inserted through the mounting ring into the outer cup and a lip at the top of the liner is supported on the mounting ring. The removable lid includes a projection that slides into the opening at the liner top. The lid screws into the mounting ring and a flange on the periphery of the lid presses the liner lip against the mounting ring, forming a liquid tight seal. Thus, the lid-ring-liner assembly may be removed from the outer cup as a liquid-tight unit. When the lid is installed on the mounting ring, the lid-ring-liner assembly may be secured to the outer cup with a locking mechanism.

In another embodiment of the present invention, a liquid container lid assembly for a spray gun is provided. The assembly includes a lid with a liquid outlet and a generally cylindrical adapter. One end of the adapter connects to the spray gun liquid inlet port and the other end connects to a liquid outlet in the lid. The adapter ends are joined by a liquid-tight passageway. A collar releasably attaches the adapter to the lid by rotation of the collar with respect to the lid.

BRIEF DESCRIPTION OF THE DRAWINGS

The foregoing features of the invention will be more readily understood by reference to the following detailed description, taken with reference to the accompanying drawings, in which.

DETAILED DESCRIPTION OF SPECIFIC EMBODIMENTS

In broad overview, in various embodiments of the invention, a liquid container system is provided for attachment to a spray gun. The system includes an outer cup, a disposable, collapsible liner for insertion into the outer cup and a removable lid that fits into an opening in the liner.

In certain embodiments of the present invention, a three piece liquid container system is provided. The system includes an outer cup, a disposable, collapsible liner for insertion into the outer cup and a removable lid that fits tightly into an opening in the liner. The liner is inserted into the cup and liquid is poured into the liner. The lid includes tabs on its periphery that mate with rib segments on the inside of an opening of the outer cup. The lid is inserted into the liner and then rotated to secure the lid/liner to the cup. The lid can include locking tabs that prevent the lid from rotating in reverse.

In other embodiments of the invention, the cup may include features, such as faceted sidewalls and protrusions on its inside bottom surface, that prevent close contact between the collapsible liner and the cup. These features facilitate complete expulsion of liquid from the liner during spraying. In certain other embodiments of the invention, an adapter is provided to connect the reservoir to the spray gun inlet port without requiring rotation of the reservoir relative to the adapter or the spray gun. The adapter may be secured to an outlet port of the lid by a removable collar.

In further embodiments of the present invention, a four piece liquid container system is provided for attachment to a spray gun. The system includes an outer cup, a mounting ring, a liner and a removable lid. The mounting ring is inserted into a recess in a flange at the top of the outer cup. A disposable, collapsible liner is inserted through the mounting ring into the outer cup and a lip at the top of the liner is supported on the mounting ring. The removable lid includes a projection that slides into the opening at the liner top. The lid screws into the mounting ring and a flange on the periphery of the lid presses the liner lip against the mounting ring, forming a liquid tight seal. Thus, the lid-ring-liner assembly may be removed from the outer cup as a liquid-tight unit. When the lid is installed on the mounting ring, the lid-ring-liner assembly may be secured to the outer cup with a locking mechanism.

Figure 1:
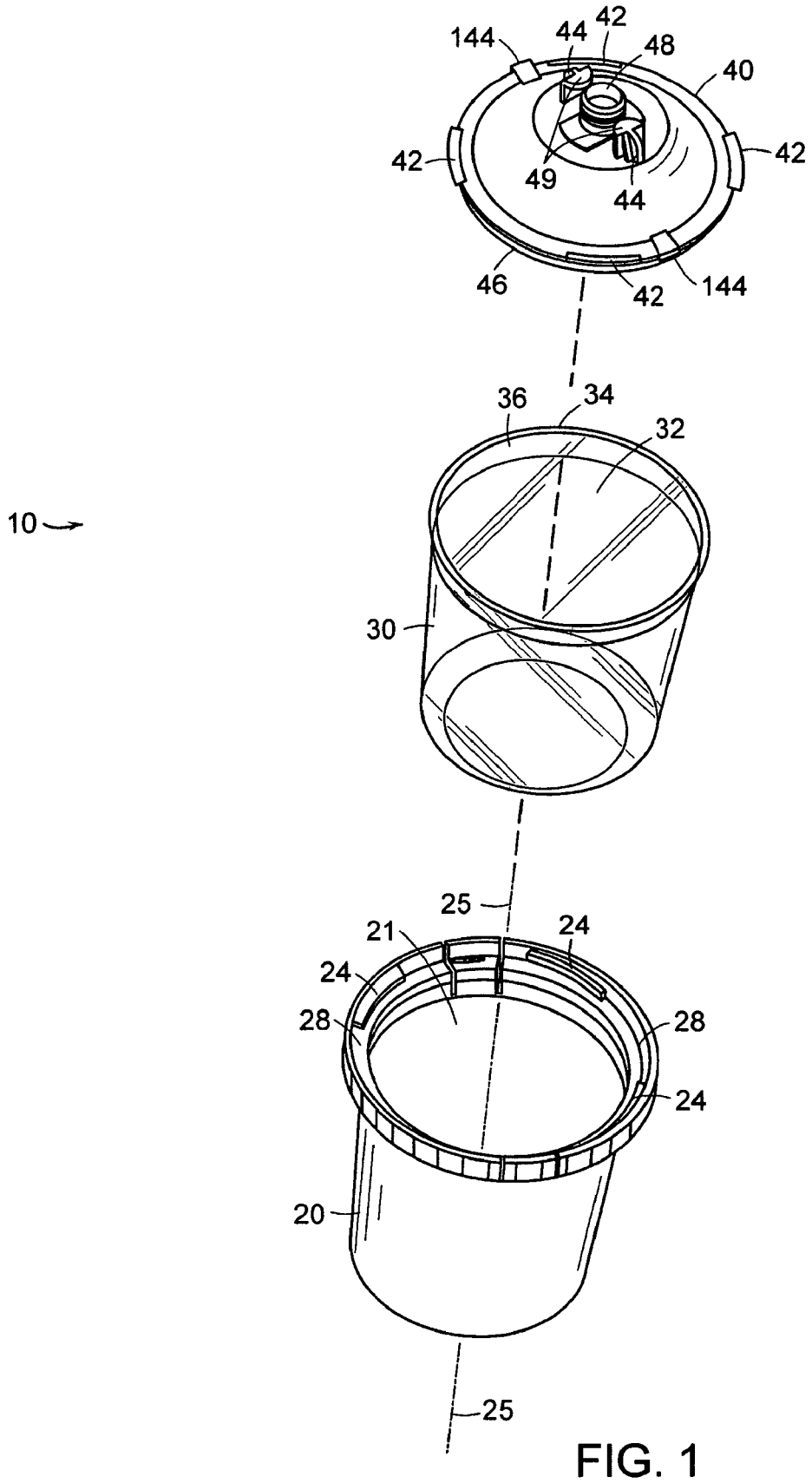
FIG. 1 shows a liquid container system according to an embodiment of the invention.

FIG. 1 shows a liquid container 10 according to an embodiment of the present invention. An outer cup 20 that is made of a relatively stiff material, such as a polymeric material, provides structural stability. The cup 20 is open at one end and is generally cylindrical in shape. The cup includes at least one opening in its bottom or sidewall to allow atmospheric pressure to equalize between the inside and outside of the cup 20. The inside of the cup opening 21 includes rib segments 24 that extend inwardly from the inner wall of the cup. These rib segments 24 are generally perpendicular to the axis 25 of the container 20 and may be pitched slightly downwardly toward the closed end of the cup to act as screw threads for securing the lid to the cup. The outside of the opening of the cup can include a series of tabs 22 that project radially outwardly from the sidewall of the cup. These tabs may be used to grip the cup 20.

Figure 2:
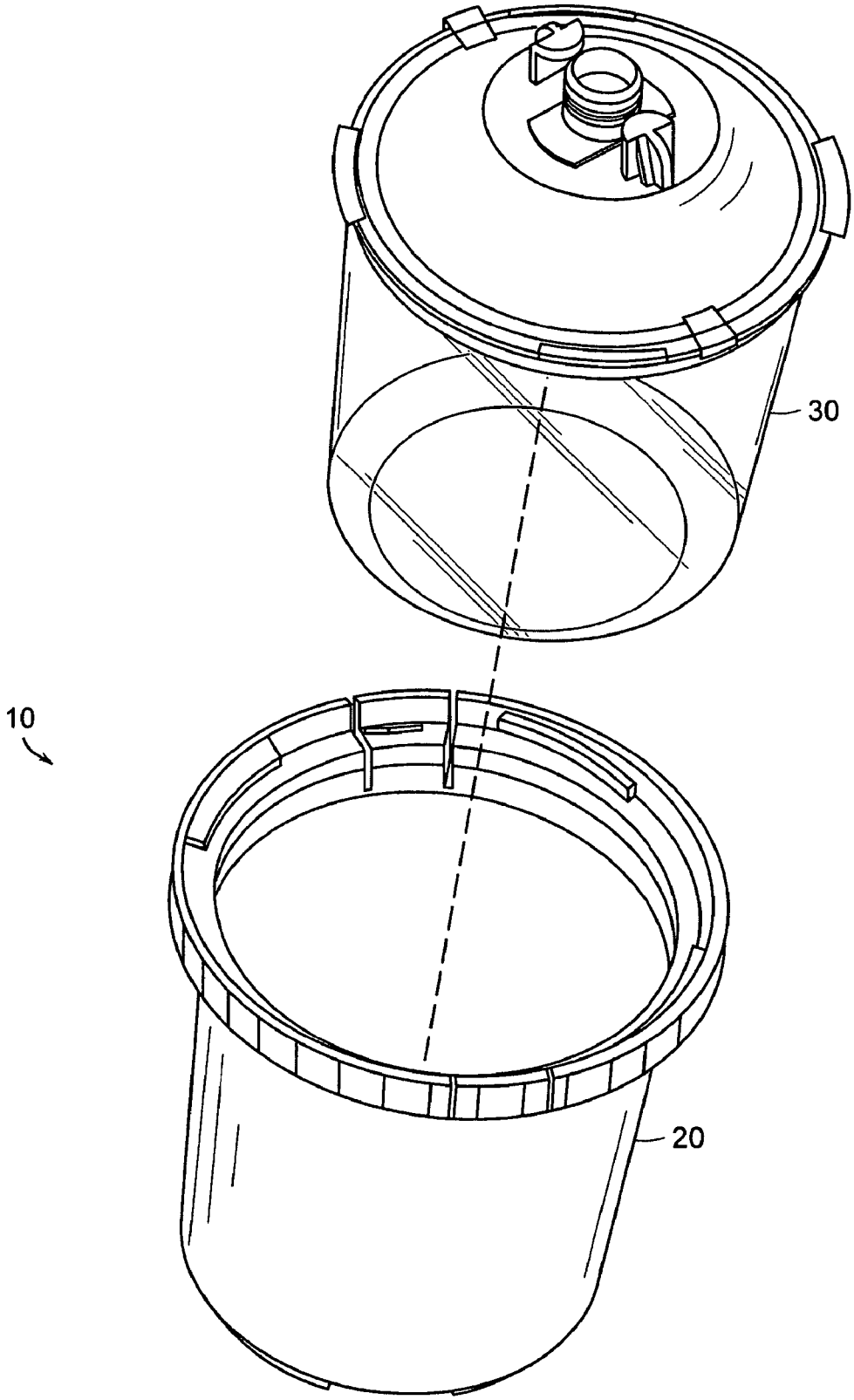
FIG. 2 shows the liner of the liquid container system of FIG. 1 aligned for insertion into a cup.

A disposable liner 30 is provided for insertion into the cup 20. The liner is closed at one end and open at the other end 32. The liner may be made of a thin polymeric material so that the liner can collapse as liquid is removed from the liner, forming a partial vacuum at the top of the liner. The liner may also be stiff enough that the liner can hold its shape while empty or filled. In one embodiment, the thickness of the liner bottom to the liner sidewalls is approximately 1:1 and the sidewalls and bottom have comparatively similar rigidity. Further embodiments provide a base thinner than the sidewalls to promote an inward collapse of the liner during spraying. The liner 30 may include a lip 34 at the open end. The lip 34 can rest upon a flange 28 on the inside of the cup so that liquid may be poured into the opening of the liner without collapsing the liner into the cup. In some embodiments of the invention, the liner is a close fit to the interior of the cup. FIG. 2 shows the liner 30 aligned for insertion into the cup 20.

A lid 40 is provided for insertion into the opening 32 in the liner 30. The lid 40 is adapted to contain paint or other liquid within the liner and to prevent air from entering the closed lid/liner combination. The lid includes an outlet 48 to allow liquid to flow from the container. In some embodiments of the invention, the lid 40 fits sufficiently tightly into the liner opening 32 that the lid/liner combination may be removed as a unit from the cup, after the liquid has been substantially removed from the liner. For example, the lid can have a cylindrical retaining wall 46 for making a frictional fit with the liner. This cylindrical retaining wall may include an outward facing rib. When pressed together, the liner fits tightly around the retaining wall to hold the liner and lid together. Alternatively, the cylindrical retaining wall may include an inward groove and the liner can have a mating inward rib that snaps or pushes into the groove to hold the liner to the lid. In some embodiments, the lid has at least two tabs 42 extending from its periphery. When the lid is inserted into the opening of the cup and rotated, these tabs mate with the rib segments described above, and secure the lid/liner combination into the cup. Either one or both of the tabs and rib segments may be angled so that rotation of the lid with respect to the cup screws the lid into the cup. Reversing this process allows the lid/liner combination to be extracted from the cup. The lid may be provided with tabs 44 that assist in rotating the lid to mate with the cup. The lid may also have a retaining structure, such as hooks 49, to assist in securing the lid to a spray assembly.

Figure 3:
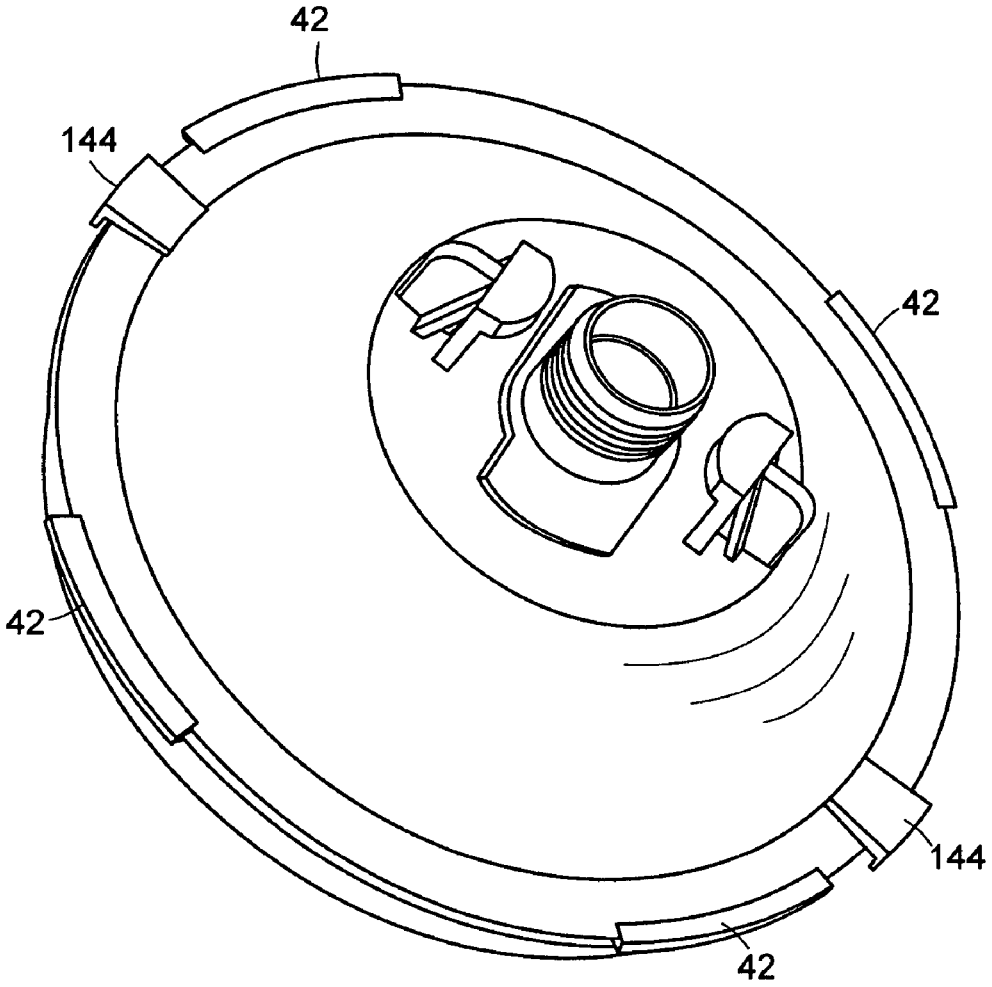
FIG. 3 illustrates a locking tab that extends from the periphery of the lid of the liquid container system of FIG. 1.
Figure 4:
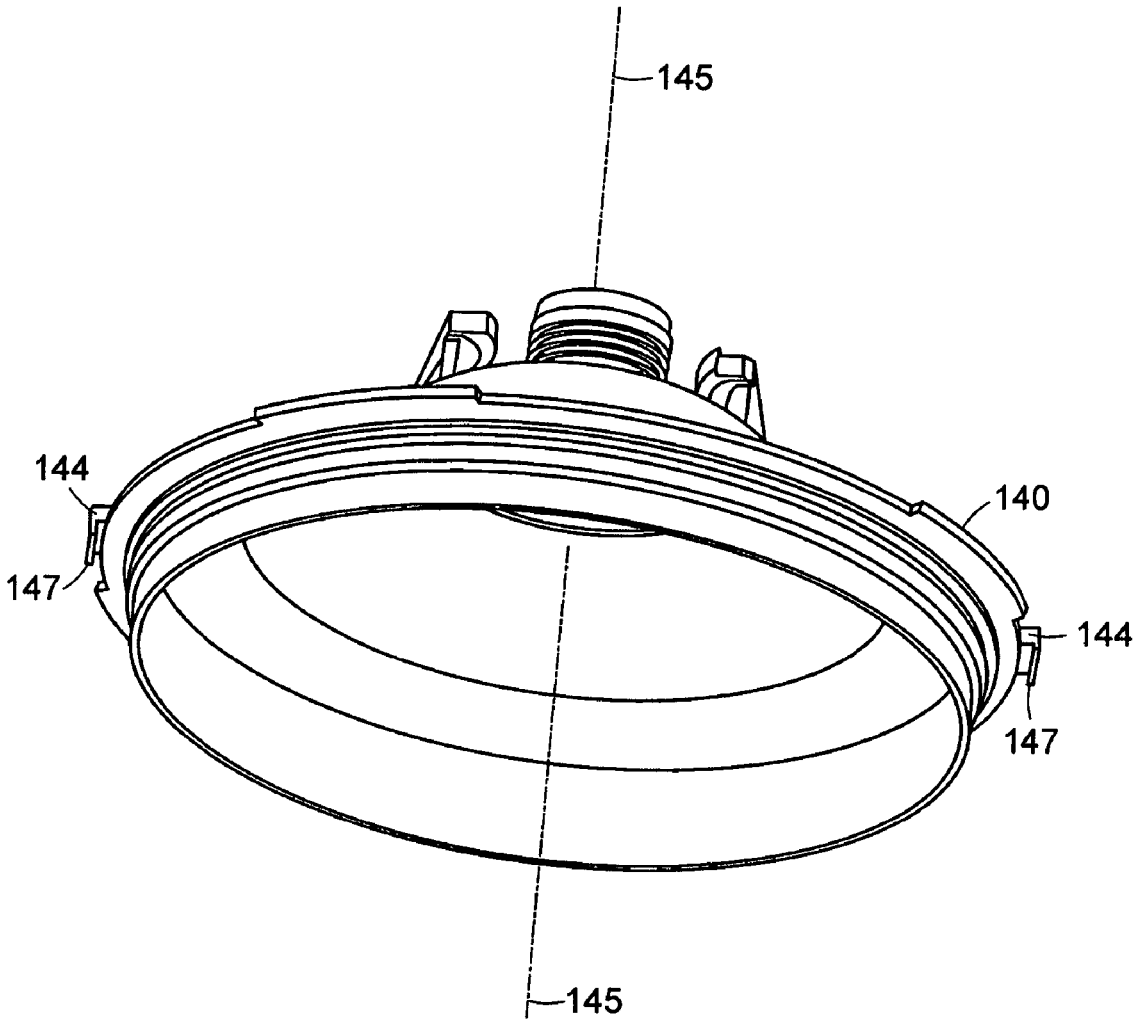
FIG. 4 shows a perspective view of the bottom of the lid of the liquid container system of FIG. 1.
Figure 5:
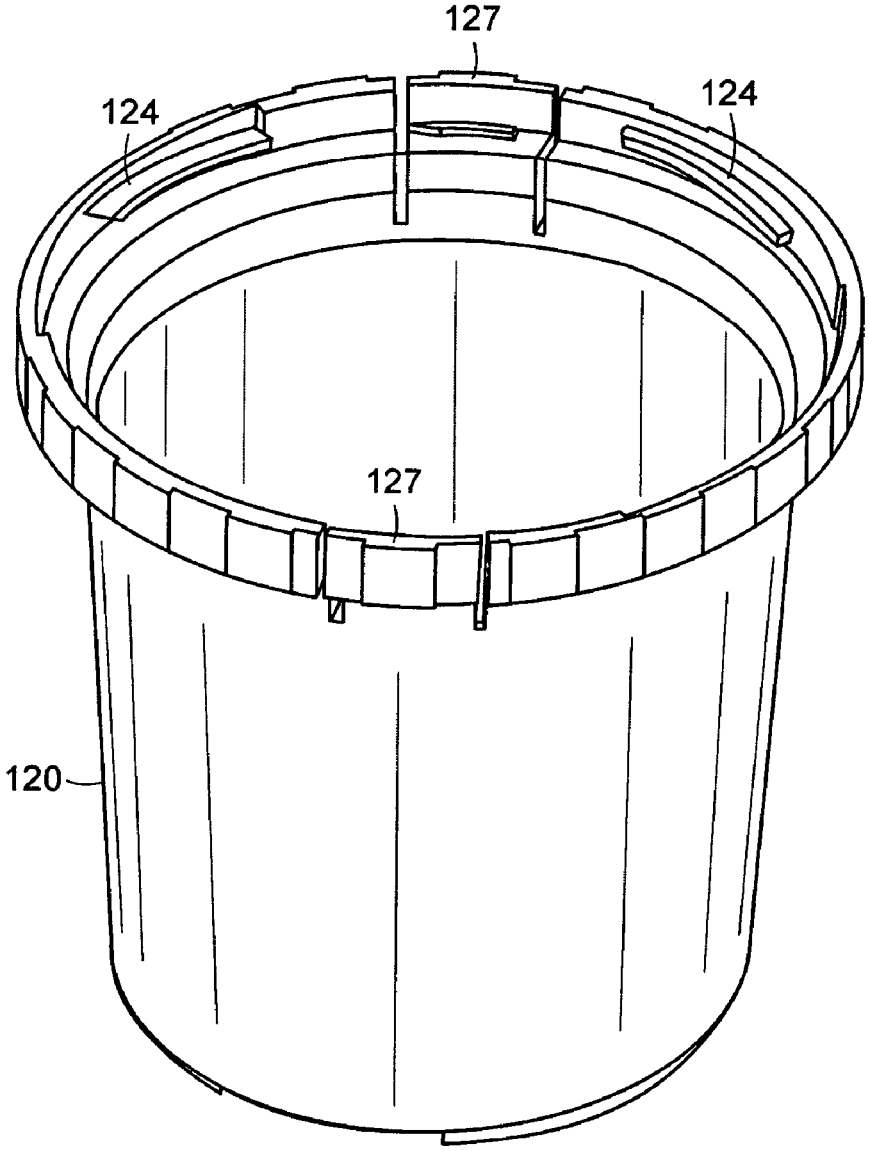
FIG. 5 shows a perspective view of the cup of the liquid container system of FIG. 1.
Figure 6:
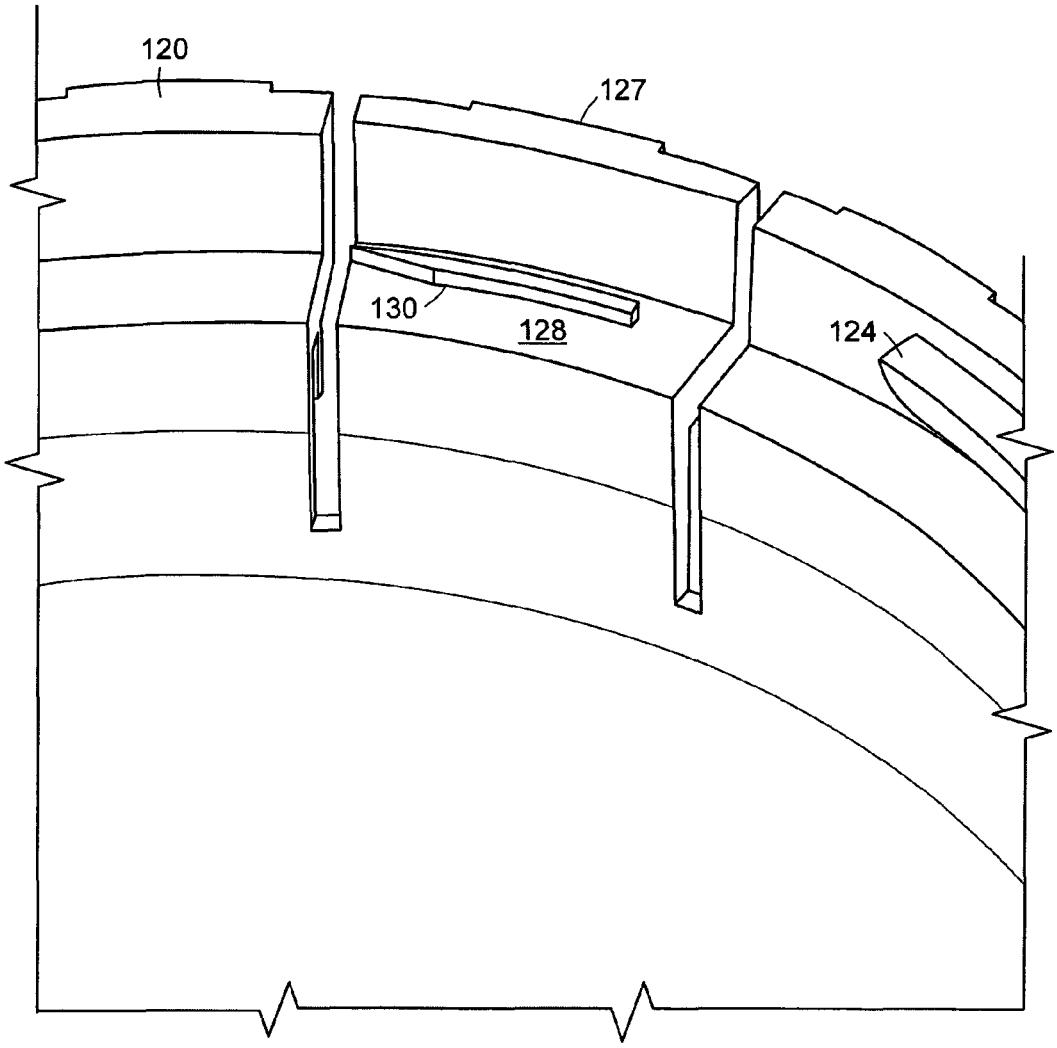
FIG. 6 shows a close-up of pinch segments of the cup of the liquid container system of FIG. 1.

In further specific embodiments of the invention, according to any of the embodiments described above, a locking mechanism prevents the lid from rotating relative to the cup in reverse. At least one locking tab 144 is provided that extends radially from the periphery of the lid 140, as shown in FIG. 3. FIG. 4 shows a perspective view of the bottom of the lid 140. Locking tab 144 includes a lead 147 that is substantially parallel to the axis 145 of the lid 140. FIG. 5 shows a perspective view of the cup 120. At least one pinch segment 127 is formed in the opening of the cup. Each pinch segment 127 includes slots cut on either side so that the pinch segments 127 can deflect radially. As shown in FIG. 6, the pinch segments 127 include an extension rib 130 on the cup's flange 128. The extension rib 130 is tapered at one end. When the lid 140 is inserted into the cup opening and rotated clockwise, the lid's locking tab lead deflects the pinch segment 127 radially outwardly. Outward deflection of the pinch segment 127 is facilitated by the taper on the extension rib 130. As rotation continues and the locking tab lead clears the extension rib, the pinch segment deflects inwardly, thus preventing the lid from rotating counter-clockwise. The cup's pinch segments 127 can be deflected radially by pinching. This action frees the lid's locking tab lead 147 from the extension rib, allowing the lid to be rotated counter-clockwise and removed.

Figure 7:
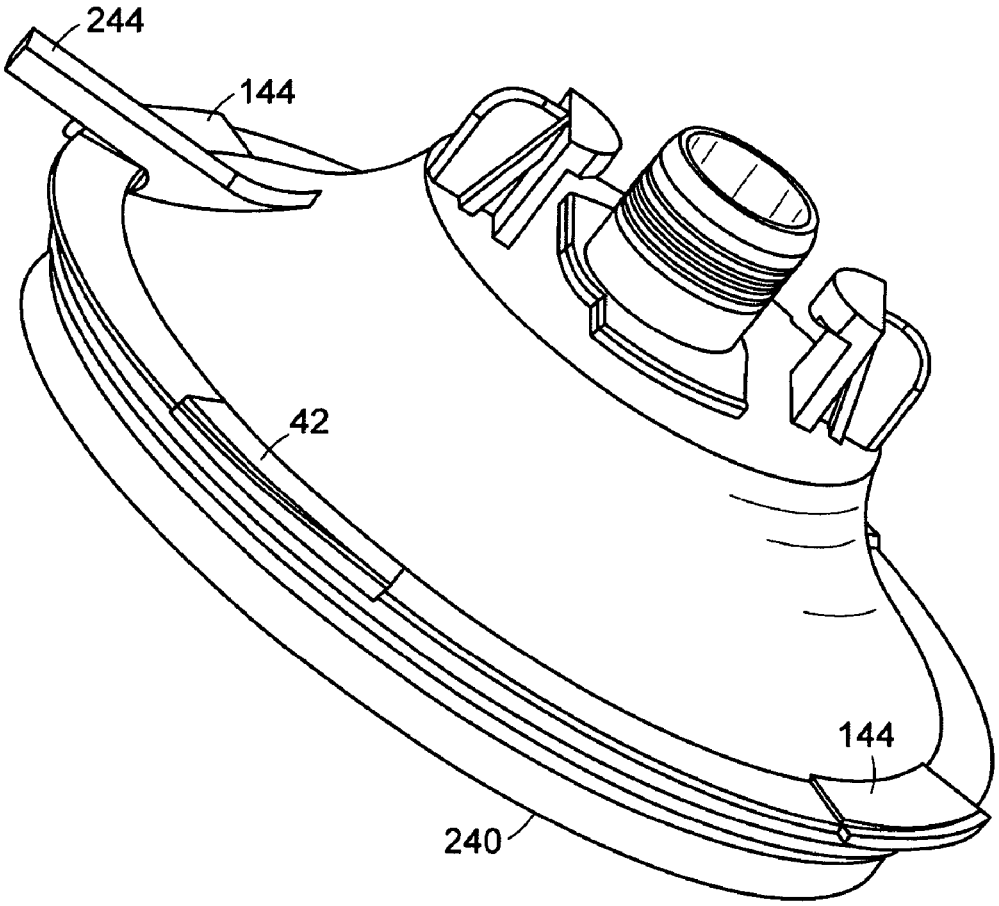
FIG. 7 illustrates, in another embodiment of the invention, an alternative locking mechanism, to prevent the lid from rotating relative to the cup.
Figure 8:
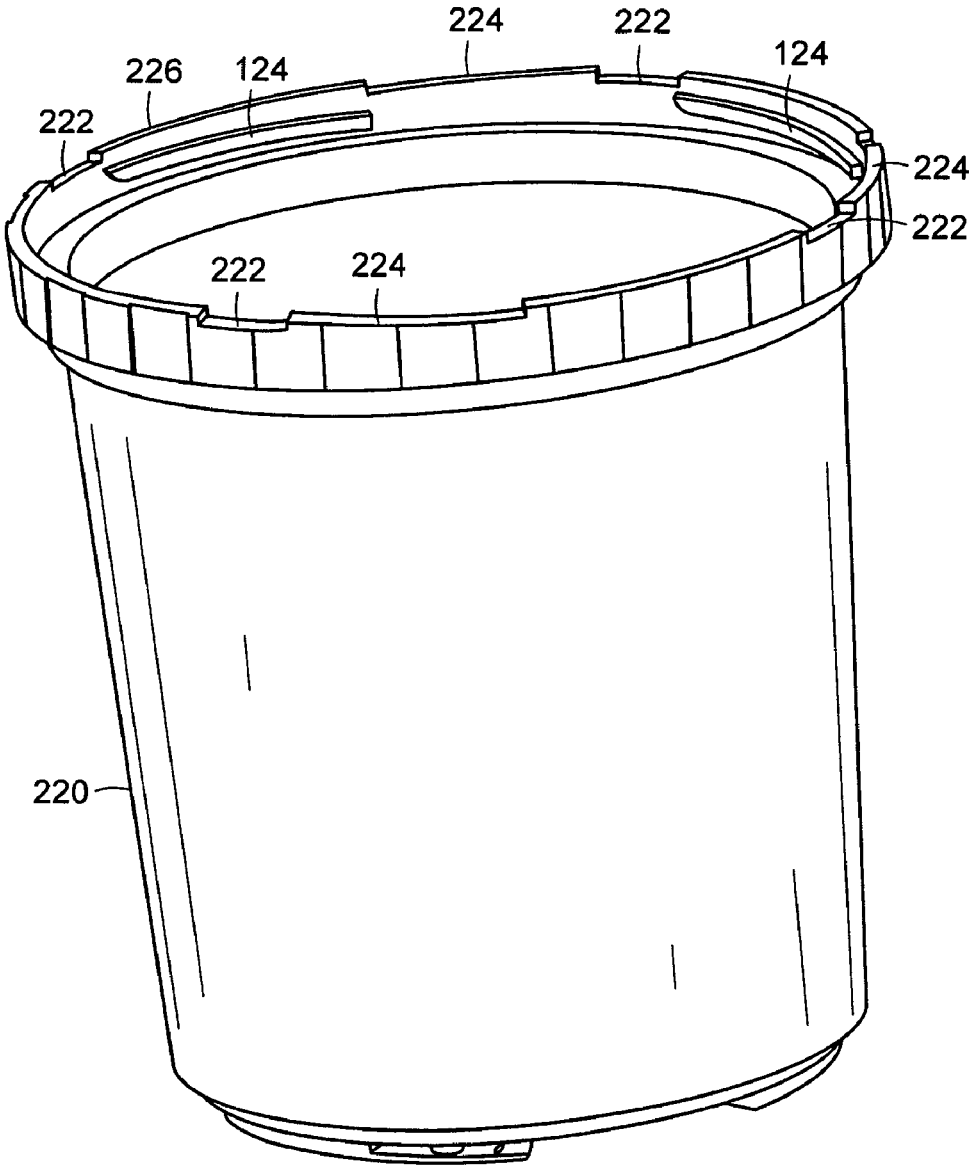
FIG. 8 shows a perspective view of the corresponding cup for the lid of FIG. 7.

In another embodiment of the invention, an alternative locking mechanism is provided for the lid, to prevent the lid from rotating relative to the cup. FIG. 7 shows a perspective view of lid 240 that includes a locking finger 244. The locking finger 244 extends radially outwardly from the periphery of the lid 240. FIG. 8 shows a perspective view of the corresponding cup 220. The cup includes at least one slot 222 cut into the rim 226 of the opening of the cup. Adjacent to the slot 222 on the rim 226 is a ramp 224 that inclines upwardly towards the slot. When the lid 240 is inserted into the cup opening and rotated clockwise, the lid's locking finger deflects upward. Upward deflection of the locking finger 244 is facilitated by the incline on the ramp 224. As rotation continues and the locking finger 244 clears the leading edge of the slot 222, the locking finger deflects downwardly into the slot 222. The locking finger 244 prevents the lid from rotating counter-clockwise. To remove the lid, the locking finger can be manually deflected upwardly and the lid rotated. This action frees the lid's locking finger from the slot, allowing the lid to be rotated counter-clockwise and removed.

Figure 9:
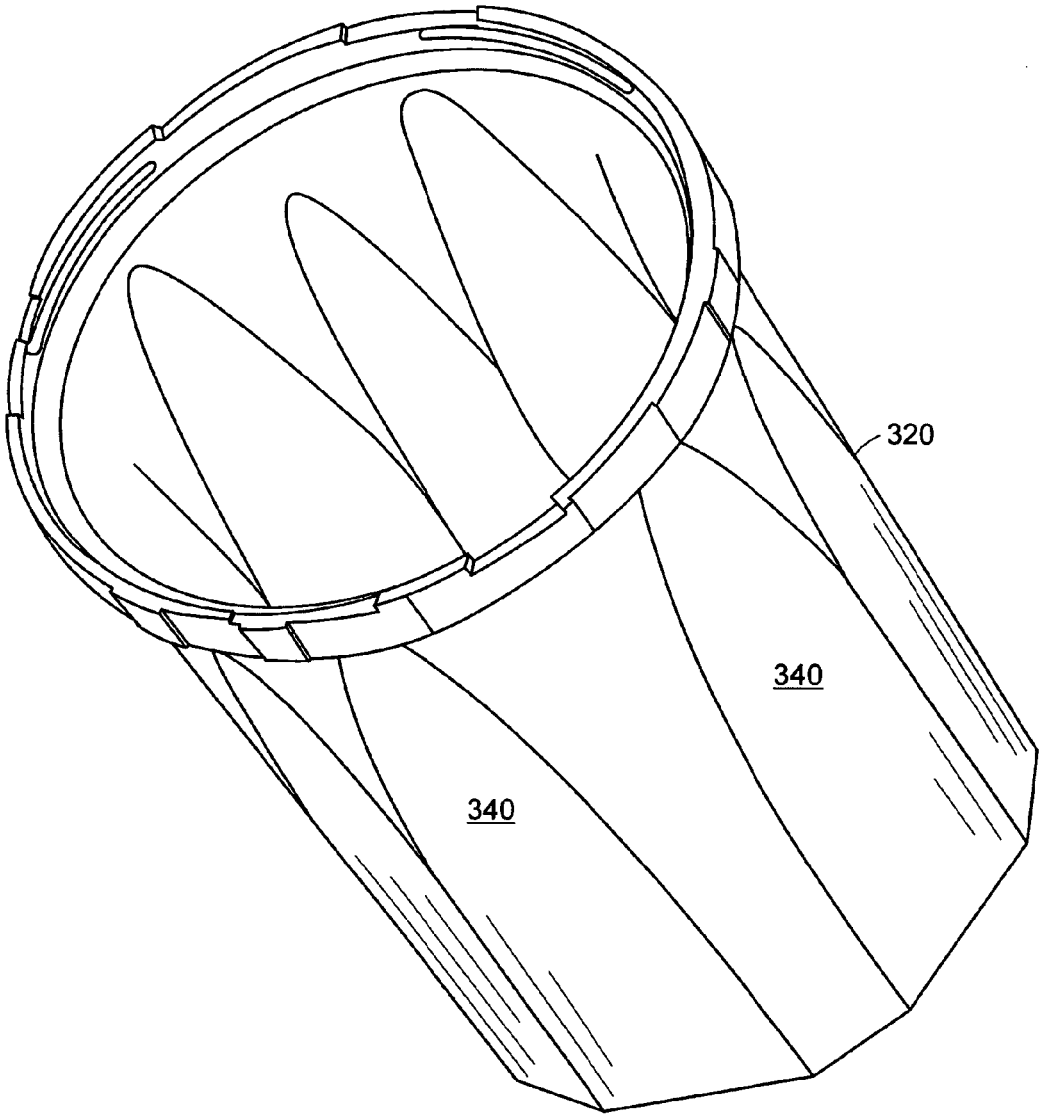
FIG. 9 illustrates a faceted outer cup according to an embodiment of the invention.
Figure 10:
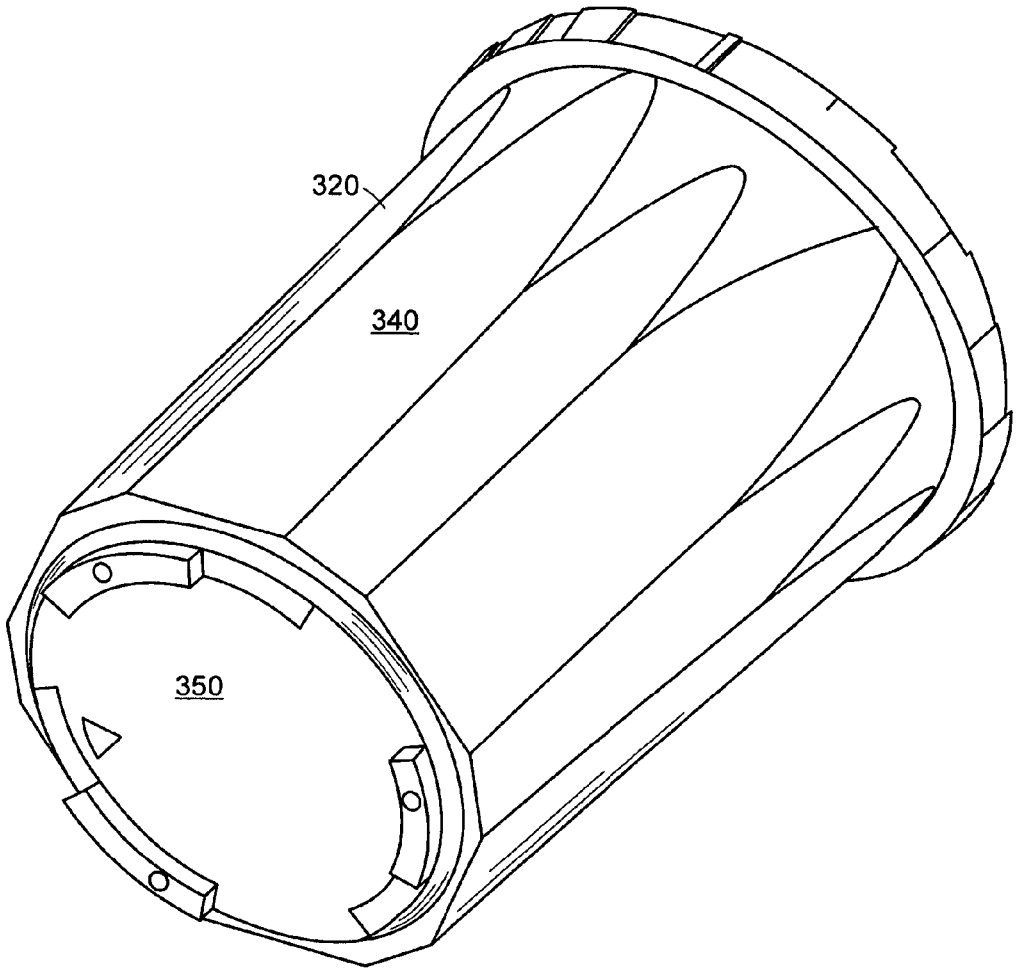
FIG. 10 shows a bottom, perspective view of the cup of FIG. 9.
Figure 11:
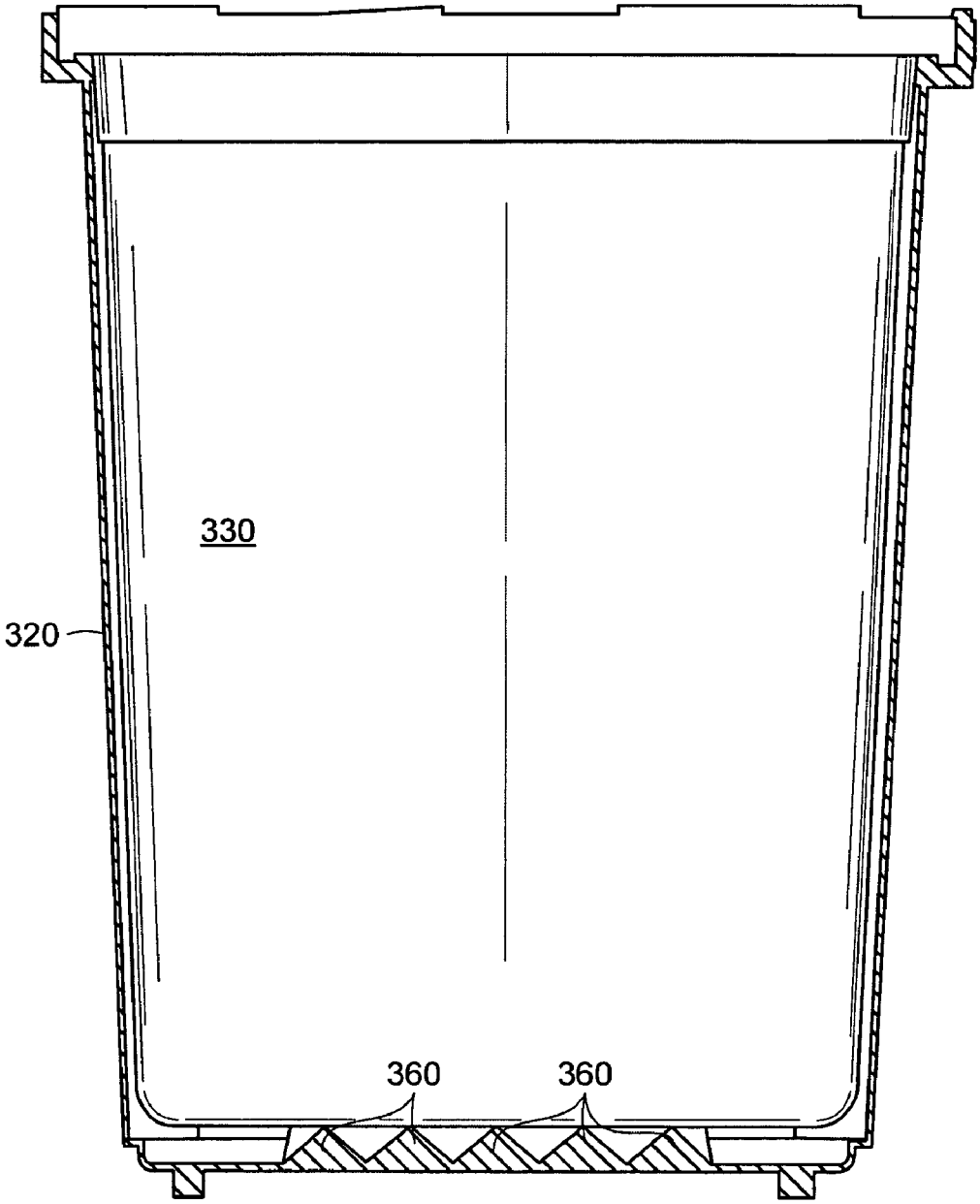
FIG. 11 shows an interior side-view of a cup according to an embodiment of the invention.

In other embodiments of the invention, an outer cup 320, shaped as shown in FIG. 9, may be employed in any of the embodiments of the invention. The cup 320 includes one or more facets 340 in its sidewall. The facets 340 may extend substantially the length of the sidewall or any portion thereof. FIG. 10 shows another view of the outer cup 320, including its bottom surface 350. The outer cup 320 may also be provided with protrusions 360 on the interior of its bottom surface 350, as shown in FIG. 11. The protrusions may be of any shape or length and may cover any portion of the interior surface of the cup bottom. In preferred embodiments, the protrusions are ridges, the length of the ridges is a small fraction of the cup height and the ridges cover less than 50% of the interior surface of the cup bottom. Alternatively, the protrusions may be pyramidal or teeth-like in shape or otherwise shaped to support the liner above the cup bottom. A collapsible liner 330 that is stiff enough to stand on its own, either empty or filled, is inserted into the cup. Such a liner will not conform to the interior sidewall or bottom surface of the cup. Thus, any tendency of the liner to cling to the cup will be overcome and liquid may be more completely withdrawn from the liner during spraying.

Figure 12:
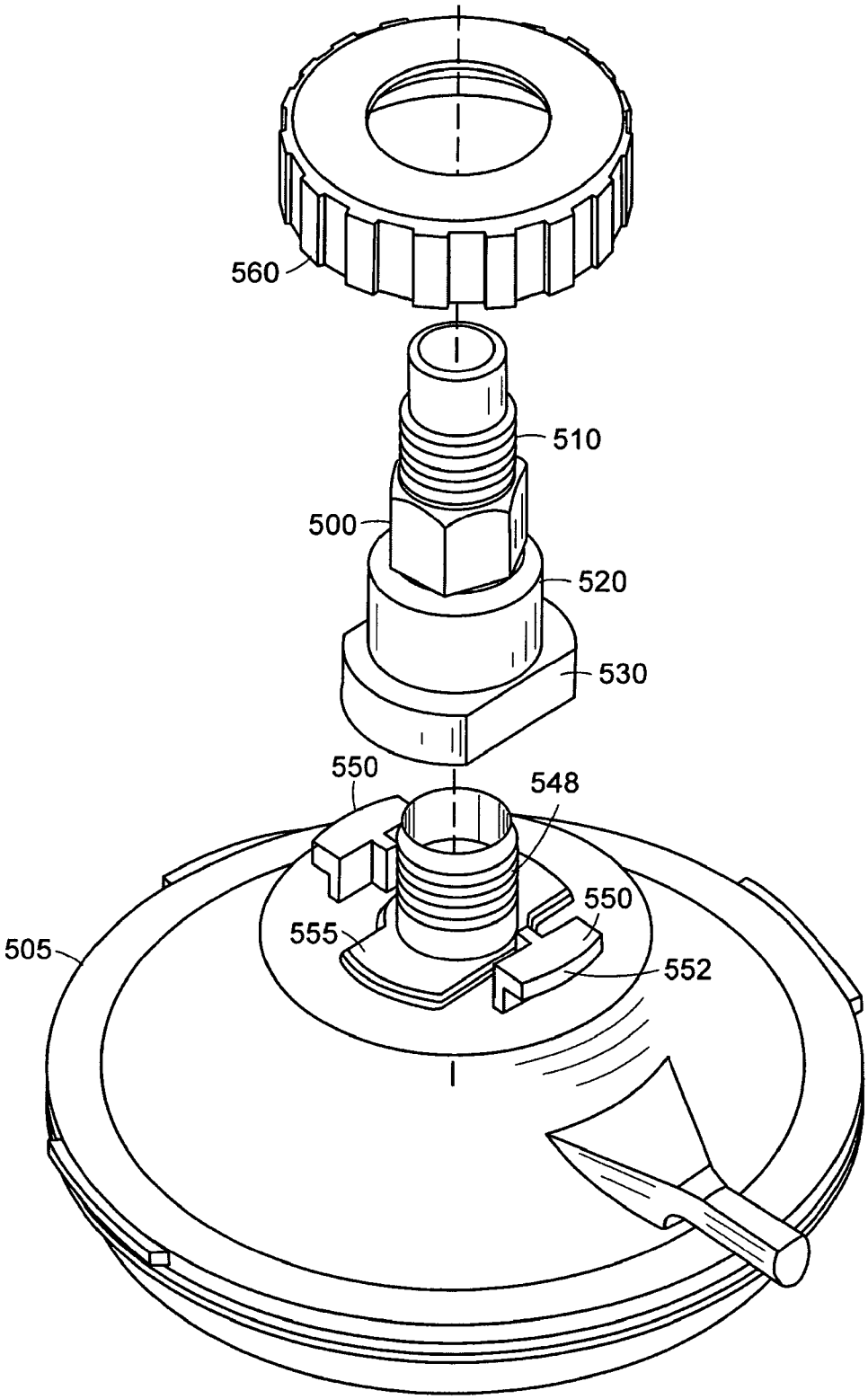
FIG. 12 illustrates a connector system for releasably mating a spray gun with a liquid reservoir, according to an embodiment of the invention.
Figure 13:
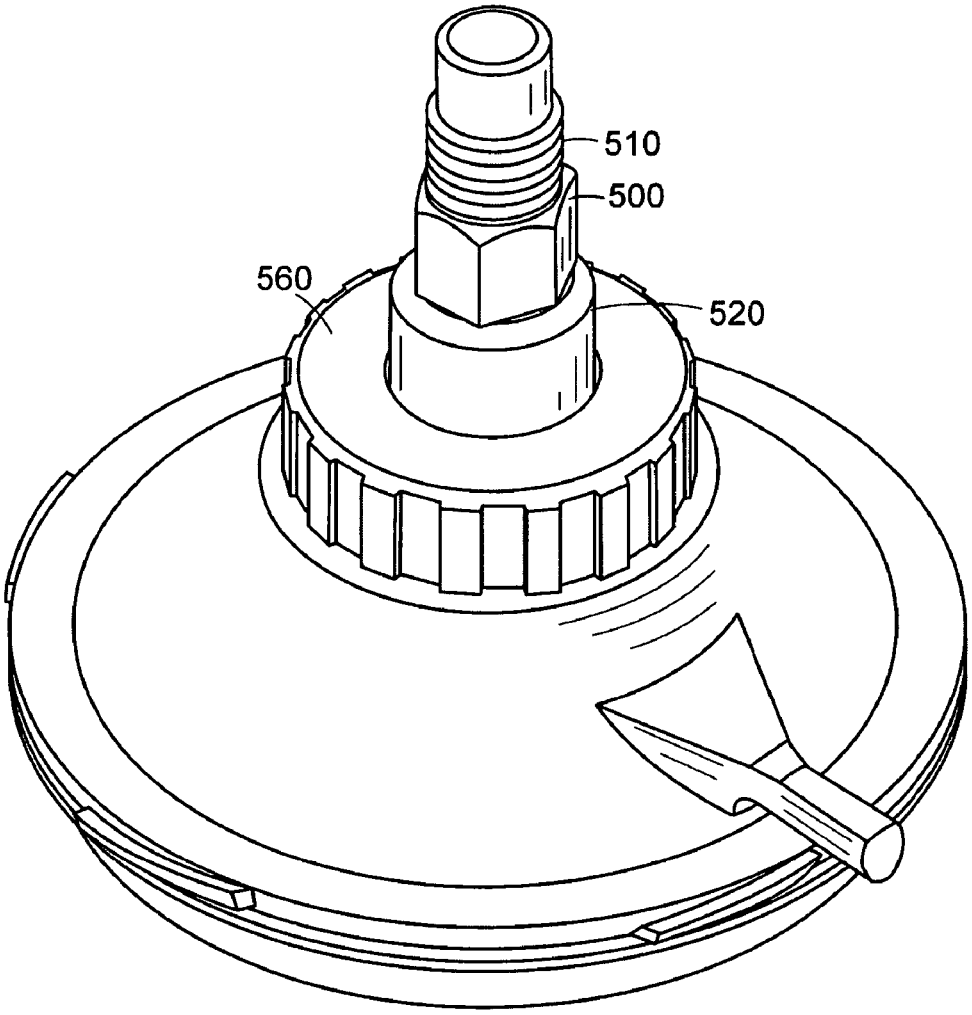
FIG. 13 shows an adapter secured to the lid by a collar for the embodiment of FIG. 12.

In certain other embodiments of the present invention, a connector system is provided for releasably mating a spray gun with a liquid reservoir. For example, without limitation, the connector system may be used with any of the liquid reservoirs shown in the figures of the present application. A removable lid 505 is provided for the reservoir, as shown in FIG. 12. The lid has an outlet 548 of generally cylindrical shape so that liquid may be transferred from reservoir to spray gun. An adapter 500 of generally cylindrical shape is provided to connect the lid outlet 548 to the spray gun inlet port. The adapter has a threaded spray gun end 510 for insertion into and attachment to the inlet port on the spray gun. The reservoir end of the adapter includes a barrel 520 that receives the lid outlet 548. The spray gun end and the reservoir end of the adapter are connected by a liquid passageway. An adapter flange 530 is provided that surrounds the barrel 520. The lid is provided with at least one projection 550 that includes at least one radially outwardly projecting tab 552 on the projection's outer surface (the surface that is distal to the axis of the lid outlet 548). The reservoir end of the spray gun adapter is seated on the flange 555 surrounding the outlet port 548 of the lid. Flange 530 fits on the lid in only one general position from which rotation is impeded by projections 550. A collar 560 is then placed over the barrel 520 of the adapter and rotated about the axis of the outlet. The projection tab 552 acts as a screw thread for the mating threads on the interior surface of the collar sidewall. Rotation of the collar engages the collar with the top surface of the flange 530 and secures the adapter to the lid. FIG. 13 shows the adapter secured to the lid. Thus, the adapter is secured to the lid without requiring rotation of the reservoir relative to the adapter. This form of connection reduces the need to handle, impart motion to or otherwise disturb filled liquid reservoirs.

Figure 14:
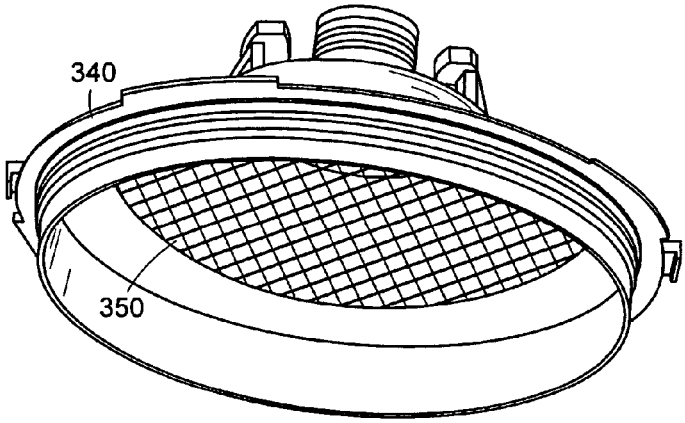
FIG. 14 illustrates a lid with an integral filter according to an embodiment of the invention.

In embodiments of the invention, the liquid container may be coupled with either a gravity feed or a suction feed spray gun, with the outlet of the lid connected to the inlet port of the gun by an adapter, such as the adapter described above. Liquid is withdrawn from the container and fed to the spray nozzle. The gun may be oriented in a wide range of orientations, including an inverted orientation with respect to gravity. In some embodiments of the invention, a filter, which may be removable, may be provided to filter the liquid withdrawn from the container. In one embodiment of the invention, a filter 350 may be built into the underside of the lid 340, as shown in FIG. 14. In various embodiments of the invention, channels are provided on the outside sidewall of the cup into which scales for measuring the liquid poured into the container may be slid.

In further embodiments of the present invention, a four piece liquid container system is provided for attachment to a spray gun. The system includes an outer cup, a mounting ring, a liner and a removable lid. The mounting ring is inserted into a recess in a flange at the top of the outer cup. A disposable, collapsible liner is inserted through the mounting ring into the outer cup and a lip at the top of the liner is supported on the mounting ring. The removable lid includes a projection that slides into the opening at the liner top. The lid screws into the mounting ring and a flange on the periphery of the lid presses the liner lip against the mounting ring, forming a liquid tight seal when the lid is screwed into the ring. Thus, the lid-ring-liner assembly may be removed from the outer cup as a liquid-tight unit. When the lid is installed on the mounting ring, the lid-ring-liner assembly may be secured to the outer cup with a locking mechanism.

Figure 15A:
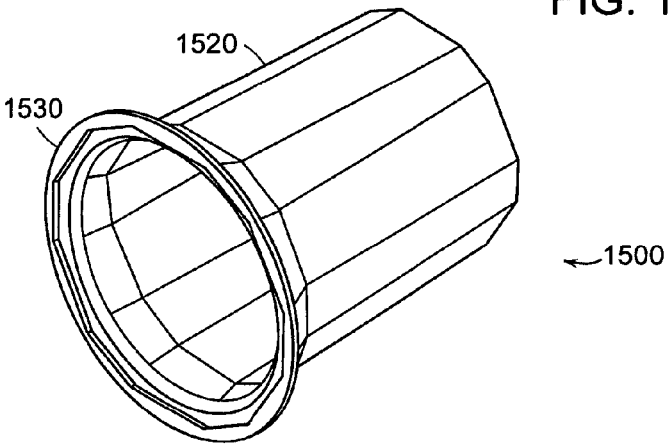
FIGS. 15A-C illustrate an outer cup for a four piece liquid container system, for an embodiment of the invention.
Figure 15B:
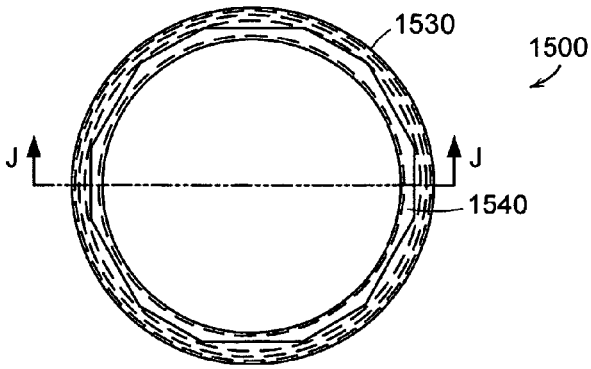
Figure 15C:
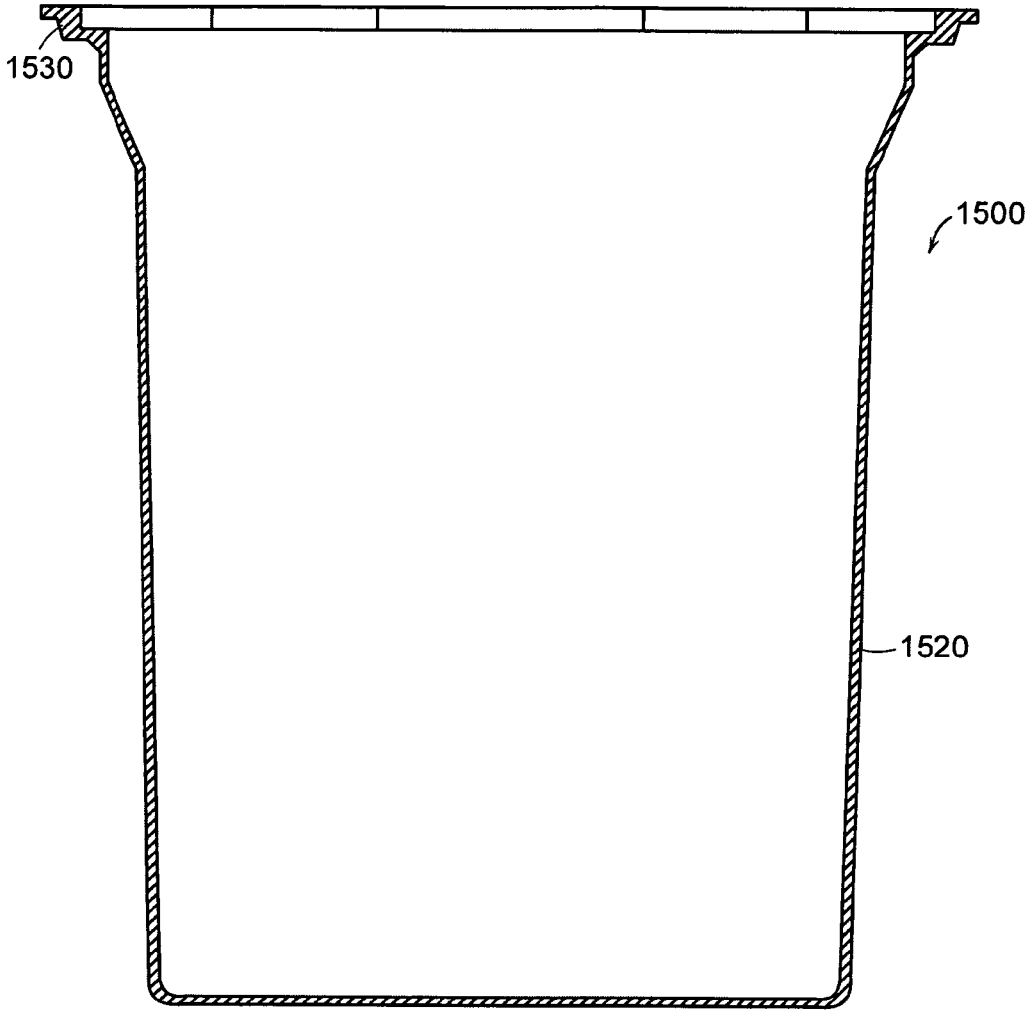

FIG. 15 shows an outer cup 1500, according to an embodiment of the four piece liquid container system. Note that the term "four piece liquid container system" is for convenience in description and not by way of limitation. The system may include other components and some of the identified four pieces of the system can be implemented as more than one component. FIG. 15A shows a perspective view of the outer cup 1500. The cup is generally cylindrically shaped. The outer cup is made of a relatively stiff material, such as a polymeric material, which provides structural stability. In the embodiment shown in FIG. 1 SA, the outer wall 1520 of the cup includes facets similar to those shown and described in and for FIG. 9. In general, however, the outer wall of the outer cup may be implemented with any generally cylindrical shape. The outside and inside bottom of the cup may be flat or may be other than flat. For example, the inside bottom may include projections, similar to those shown in FIG. 11. The top of the outer cup includes a generally cylindrical lip 1530 that is concentric with the longitudinal axis of the outer cup. FIG. 15B shows a plan view of the cup lip 1530 as viewed from above. The lip 1530 includes a polygonal indentation or recess 1540 in the lip. This recess 1540 receives and supports the mounting ring-liner assembly, as will be described below. While the recess is shown shaped as a twelve-sided polygon, the number of faces on the recess polygon is exemplary only and not by way of limitation. The recess may assume other shapes in other embodiments of the invention, such as an annulus. FIG. 1 SC shows the outer cup in cross section. In specific embodiments of the invention, the outer cup includes an opening in its bottom or sidewall to prevent vacuum formation and to allow paint to be expelled from the container system.

Figure 16A:
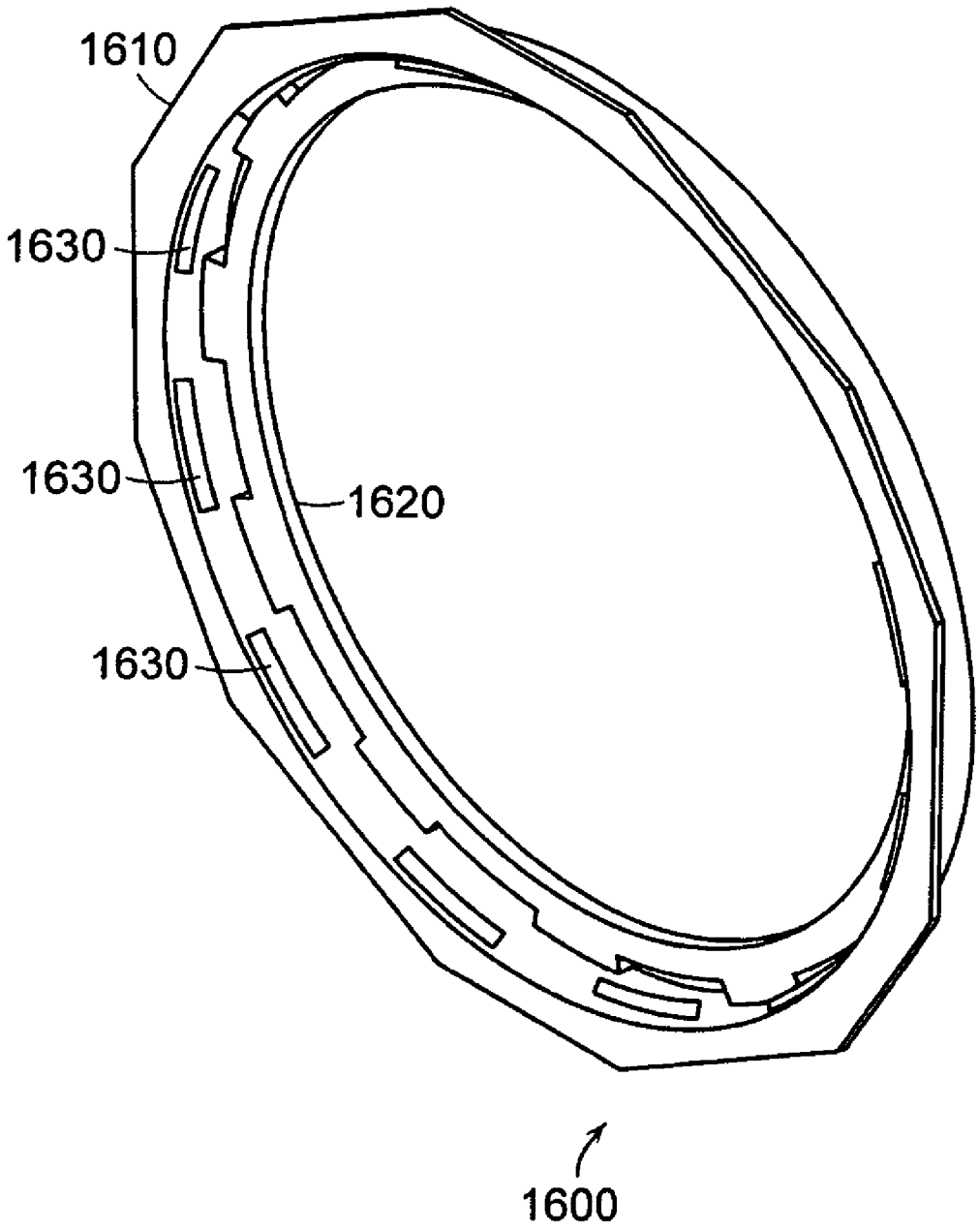
FIGS. 16A-C show a mounting ring for supporting a liner within the outer cup of the embodiment of FIG. 15.
Figure 16B:
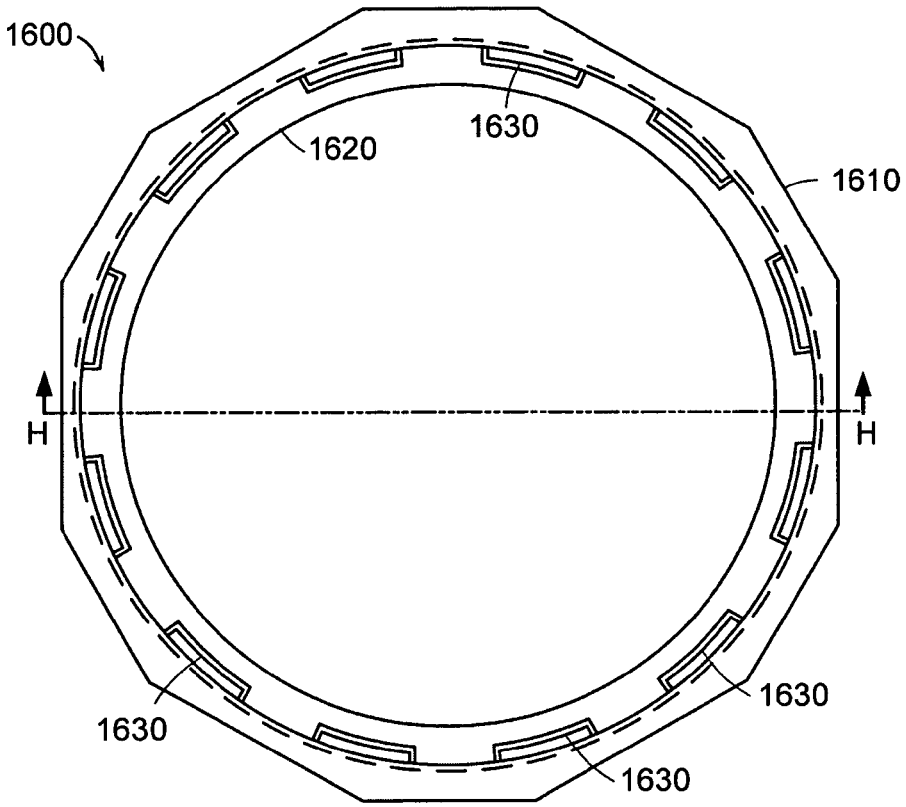
Figure 16C:
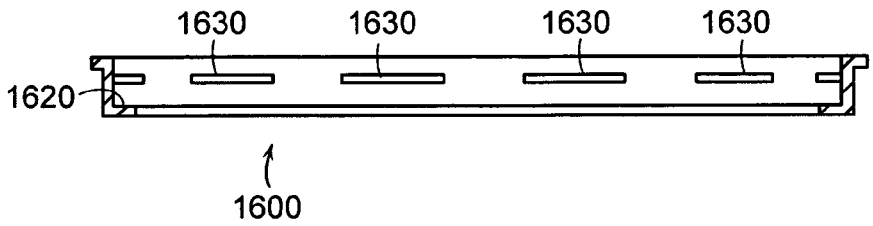

FIGS. 16 A-C show a mounting ring 1600, according to an embodiment of the four piece liquid container system. FIG. 16A shows the ring 1600 in a perspective view. The ring is generally annular in shape with the periphery of the annulus shaped to match the recess in the lip of the outer cup. As shown in FIGS. 16A and 16B, the periphery of the ring 1610 is polygonal with twelve sides for insertion into the polygonal recess 1540 in the lip of the outer cup. The polygonal shape is advantageous for the ring in that when inserted into the outer cup, the ring will not rotate. Of course, the shape for the periphery of the ring is exemplary only and may be any shape that corresponds to the recess in the lip of the outer cup. The ring 1600 includes a recess 1620 for receiving and supporting a lip at the open end of the liner, as will be described below. The recess is annular in shape with a circular periphery, but, in general, may assume any shape that corresponds to the shape of the lip of the liner. The inside of the mounting ring includes rib segments 1630 that extend inwardly from the inner wall of the ring. These rib segments 1630 are generally parallel to the plane of the ring 1600 and may be pitched slightly downwardly toward the cup end of the ring to act as screw threads for securing a lid to the ring.

Figure 17:
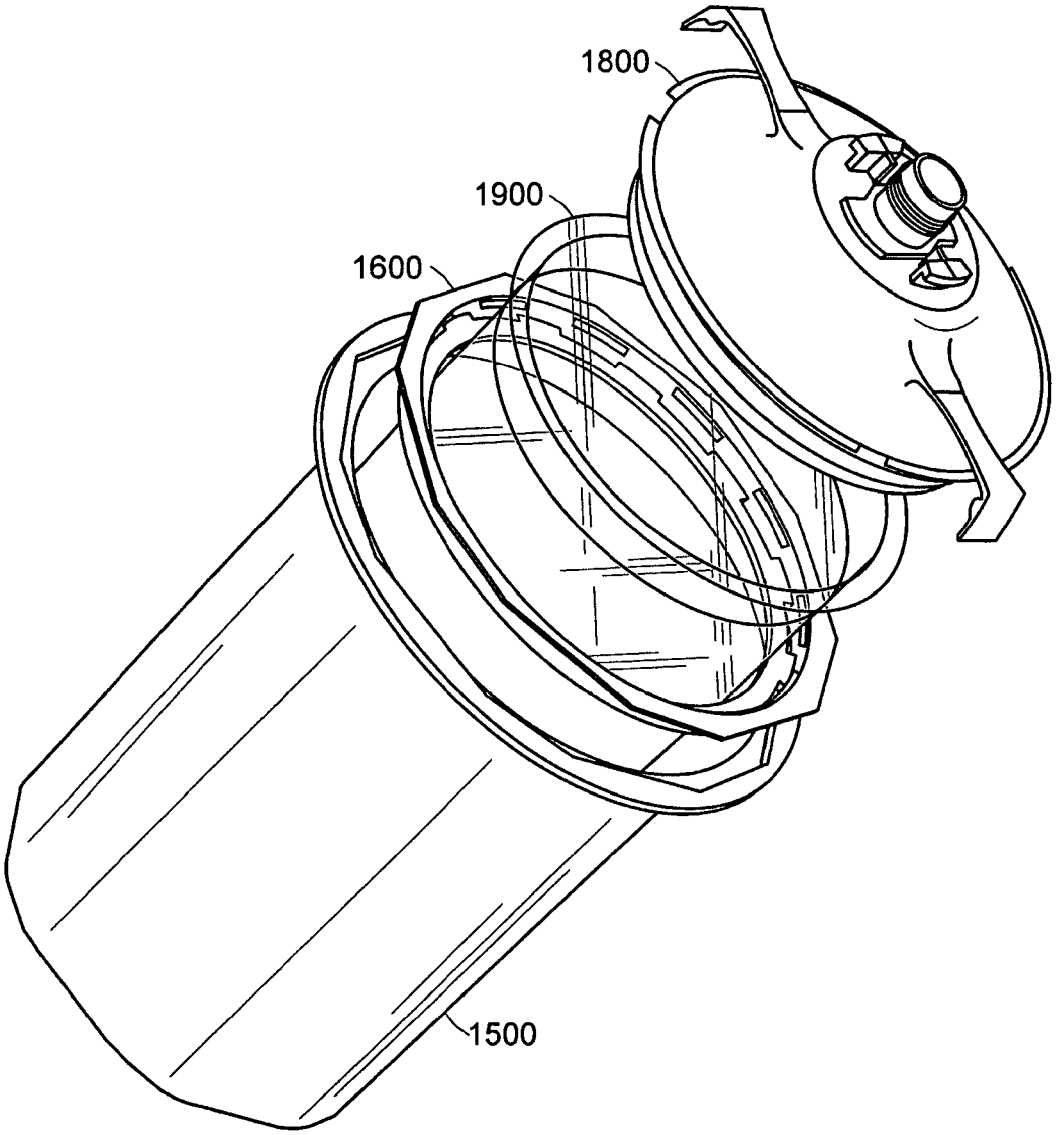
FIG. 17 is an assembly drawing for the liquid container system of FIGS. 15-16.
Figure 18A:
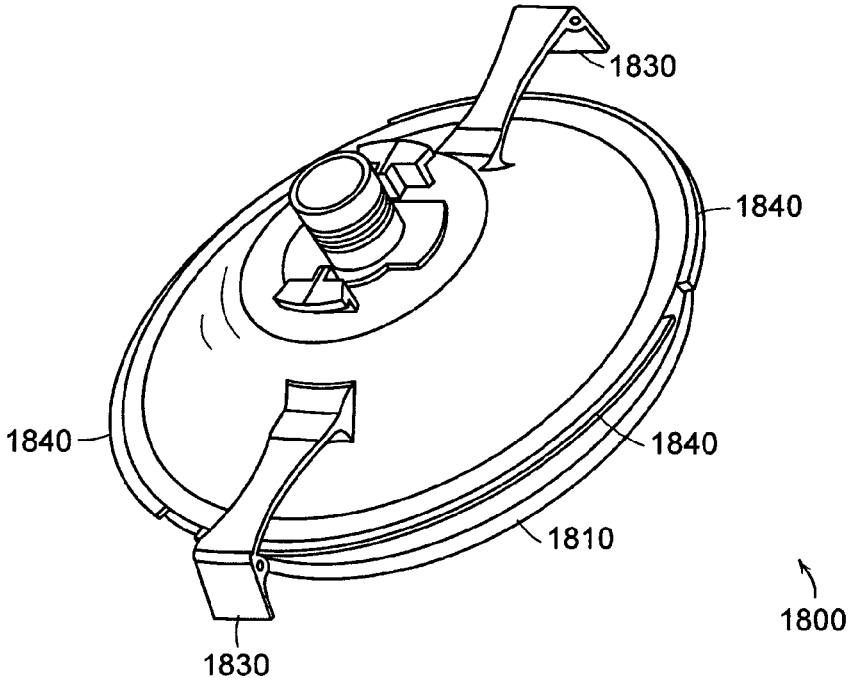
FIG. 18A-B show a removable lid according to an embodiment of the invention that may be used in system of FIG. 17.
Figure 18B:
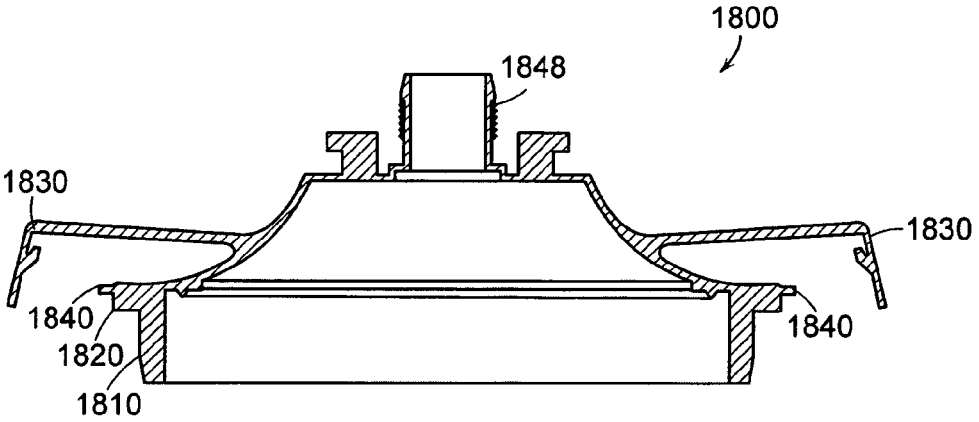
Figure 19:
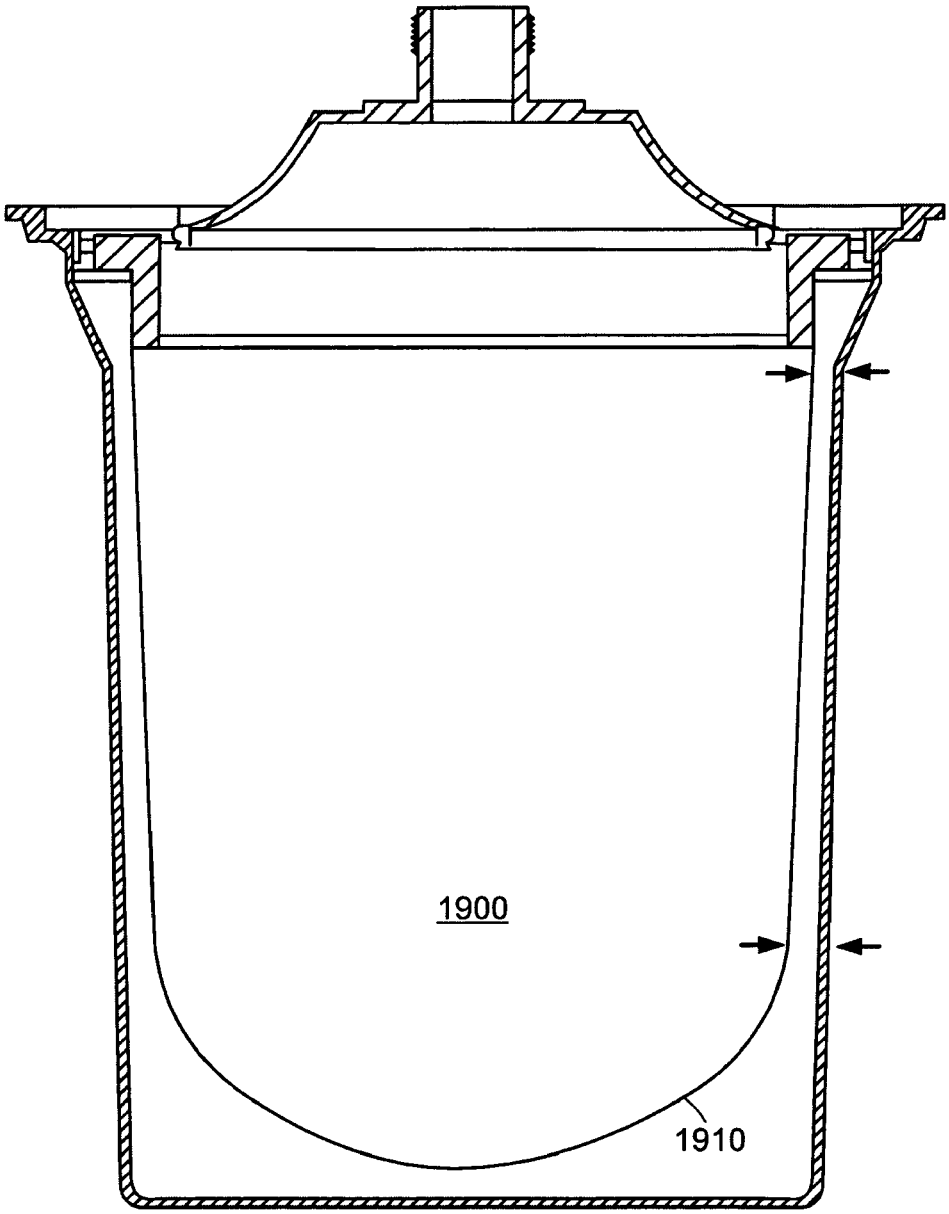
FIG. 19 shows a collapsible liner for use in a liquid container system, according to an embodiment of the invention.

FIG. 17 shows, in perspective, the components that may be included in the four piece liquid container system, according to an embodiment of the invention. The mounting ring 1600 is inserted into the recess in the lip at the open end of the outer cup 1500. A liner 1900 is inserted into the mounting ring, with a lip at the top of the liner resting on the recess 1620 in the mounting ring. While the liner of FIG. 19 is shown, any liner as described in this detailed description may be used in embodiments of the invention. A removable lid 1800, as shown in FIG. 18, includes a bottom projection 1810 that is inserted into the open end of the liner, after liquid has been poured into the liner. The lid 1800 is adapted to contain paint or other liquid within the liner and to prevent air from entering the closed lid/liner combination. The underside of a flange 1820 on the periphery of the lid forces the lip of the liner to the mounting ring recess, forming a seal. In specific embodiments of the invention, the diameter of the lid bottom projection 1810 and the inner diameter of the ring recess 1620 are such that the top of the sidewall of the liner is compressed when the lid is attached to the mounting ring. Compression of the liner sidewall between lid bottom projection 1810 and ring recess 1620 in this embodiment aids in forming a liquid tight seal. The lid bottom projection 1810 and the inner edge of the mounting ring recess 1620 may both be tapered to aid in assembly of the liner, lid and mounting ring. Tabs 1840 at the edge of the lid allow the lid to be screwed into rib segments 1630 on the mounting ring, securing the lid to ring. FIG. 18 shows the tabs 1840 extending the majority of the circumference of the edge of the lid, but shorter tabs will also perform the function. A locking mechanism 1830 on the lid can clamp the lid to the outer cup 1500, allowing the liquid container system to be oriented in any direction without danger of detachment of the outer cup from the system. As illustrated in FIG. 18, the locking tabs 1830 clip over a flange on the outer cup. The tabs may be hinged and biased to snap onto the flange of the outer cup. The lid has an outlet 1848 of generally cylindrical shape so that liquid may be transferred from outer cup to the spray gun. The lid outlet, an adapter for connection to a spray gun that mates thereto and means for securing the adapter to the outlet may be constructed as described above in connection with FIG. 12. Other types of liquid outlets, adapters and means for securing the adapter to the outlet may be employed in other embodiments of the invention. The locking mechanism shown for connecting the lid to the outer cup is by way of example only and a variety of such mechanisms, as are known in the art, may be used to secure the lid to the cup, in various embodiments of the invention.

Any of the liners shown and described above for embodiments of the invention, may be employed in embodiments of the four piece liquid container system. A liner for use in the system, in general, will be:

liquid tight;

collapsible so that liquid may be expelled from the container system; and open-ended with a lip surrounding the open end, so that the lip may be supported by the recess in the mounting ring and the lip may be pressed by the flange 1820 of the removable lid against the ring. Within these broad outlines, the material used for the liner may vary and the shape of the body of the liner may assume a variety of shapes. For example, the liner body may have pleats and the bottom of the liner body need not be flat. The liner may be made of a thin polymeric material so that the liner can collapse as liquid is removed from the top of the liner, forming a vacuum at the top of the liner. As in other embodiments of the invention, an opening or openings placed in the bottom or side wall of the outer cup allows air to enter the space between liner and cup. The liner may also be stiff enough that the liner can hold its shape while empty or filled. In one embodiment, the thickness of the liner bottom to the liner sidewalls is approximately 1:1 and the sidewalls and bottom have comparatively similar rigidity. Further embodiments provide a base thinner than the sidewalls to promote an inward collapse of the liner during spraying.

In an embodiment of the invention, as shown in FIG. 19, a liner 1900 for use in a liquid container system is provided. The liner has a non-flat bottom 1910, as shown in cross-section in FIG. 19. The liner of the embodiment shown in FIG. 19 includes a bottom that is rounded (approximately hemispherical), but in other embodiments the bottom may be shaped in other ways that are not flat.

In embodiments of the invention, the four piece liquid container may be coupled with either a gravity feed or a suction feed spray gun, with the outlet of the lid connected to the inlet port of the gun by an adapter, such as the adapter described above. Liquid is withdrawn from the container and fed to the spray nozzle. The gun may be oriented in a wide range of orientations, including an inverted orientation with respect to gravity. In some embodiments of the invention, a filter, which may be removable, may be provided to filter the liquid withdrawn from the container. In one embodiment of the invention, a filter 350 may be built into the underside of the lid 1800, similar to the filter arrangement shown in FIG. 14. In various embodiments of the invention, channels are provided on the outside sidewall of the cup into which scales for measuring the liquid poured into the container may slide.

It will, of course, be apparent that the present invention is not limited to the aspects of the description set forth above. Various changes and modifications of this invention as described will be apparent to those skilled in the art without departing from the spirit and scope of this invention.

What is claimed is:

1. A liquid container assembly for a spray gun, comprising:

a ring comprising a peripheral flange, a ring recess, an inner wall, and at least one rib segment extending from the inner wall;

a collapsible liner comprising:

a liner side wall having an open end and an outwardly rounded bottom; and a liner lip at the open end of the liner side wall, wherein the liner side wall is configured to maintain its shape while empty and filled, and wherein the liner lip is configured to be received and supported by the ring;

a cup configured to receive the collapsible liner and support the ring, the cup having a different shape than the collapsible liner when the collapsible liner is filled with liquid, wherein the outwardly rounded bottom of the collapsible liner is spaced apart from the cup when the collapsible liner is filled with liquid; and a lid for closing the open end of the liner, wherein:

the lid includes at least one tab configured to engage the at least one rib segment of the ring, and the lid includes an outlet adapted to dispense liquid to a gravity fed spray gun.

2. The liquid container assembly of claim 1, further comprising a first seal formed between the ring, the lid, and the collapsible liner.

3. The liquid container assembly of claim 2, wherein the lid further comprises a flange extending from a periphery of the lid.

4. The liquid container assembly of claim 3, wherein the flange is configured to force the liner lip onto the ring recess to form the first seal.

5. The liquid container assembly of claim 2, further comprising a second seal formed between the ring, the lid, and the collapsible liner.

6. The liquid container assembly of claim 5, wherein the lid further comprises a lid bottom projection that extends into the open end of the collapsible liner when the lid is engaged with the ring.

7. The liquid container assembly of claim 6, wherein at least one of an outer wall of the lid bottom projection and an inner wall of the ring recess is tapered to aid in assembling the collapsible liner, the lid, and the ring.

8. The liquid container assembly of claim 1, wherein a gap width between the collapsible liner and the cup increases as measured in a direction away from a bottom surface of the lid toward the outwardly rounded bottom of the collapsible liner.

9. The liquid container assembly of claim 1, wherein the ring does not extend past a midpoint of the length of the liner.

10. The liquid container assembly of claim 1, wherein the ring is generally annular and includes an outer periphery that is configured to fit into a generally annular recess formed in an outer member.

11. The liquid container assembly of claim 10, wherein the liquid container assembly is configured to fit into the outer member for filling the liquid container assembly with a liquid.

12. The liquid container assembly of claim 1, wherein the liner-ring-cap assembly is configured to secure with the spray gun, and wherein the cup is detachable from the liner-ring-cap assembly.

13. The liquid container assembly of claim 1, wherein the cup is generally cylindrical.

14. The liquid container assembly of claim 1, wherein the rounded bottom has an outwardly hemispherical surface.

15. The liquid container assembly of claim 1, wherein the collapsible liner is thinner at the outwardly rounded bottom than the side walls.

16. The liquid container assembly of claim 1, wherein an interior surface of the cup has a generally flat bottom.

17. The liquid container assembly of claim 16, wherein the outwardly rounded bottom of the collapsible liner is entirely spaced apart from the generally flat bottom of the cup.

18. The liquid container assembly of claim 1, wherein an interior surface of the cup has a bottom surface, and wherein protrusions on the bottom surface of the cup prevent contact between the collapsible liner and the cup.

19. The liquid container assembly of claim 1, wherein the peripheral flange of the ring is disposed below the liner lip, and wherein a portion of the cup is disposed below the ring.

20. The liquid container assembly of claim 1, wherein the liquid container assembly and the spray gun are gravity fed.

* * * * *